US009737754B2

(12) United States Patent
Chuang

(10) Patent No.: US 9,737,754 B2
(45) Date of Patent: Aug. 22, 2017

(54) STEPPER

(71) Applicant: Lung-Fei Chuang, Taichung (TW)

(72) Inventor: Lung-Fei Chuang, Taichung (TW)

( * ) Notice: Subject to any disclaimer, the term of this patent is extended or adjusted under 35 U.S.C. 154(b) by 0 days.

(21) Appl. No.: 14/931,829

(22) Filed: Nov. 3, 2015

(65) Prior Publication Data

US 2016/0271440 A1 Sep. 22, 2016

(30) Foreign Application Priority Data

Mar. 20, 2015 (TW) ..... 104204233 U

(51) Int. Cl.

| | |
|---|---|
| ***A63B 22/04*** | (2006.01) |
| ***A63B 22/00*** | (2006.01) |
| ***A63B 21/00*** | (2006.01) |
| ***A63B 23/04*** | (2006.01) |
| ***A63B 21/055*** | (2006.01) |

(52) U.S. Cl.

CPC .... *A63B 22/0056* (2013.01); *A63B 21/00061* (2013.01); *A63B 21/00069* (2013.01); *A63B 21/00189* (2013.01); *A63B 21/055* (2013.01); *A63B 22/0012* (2013.01); *A63B 23/0458* (2013.01)

(58) Field of Classification Search

CPC ..... A63B 22/0023; A63B 22/0048; A63B 22/0056; A63B 22/0058; A63B 22/0064; A63B 22/0066; A63B 22/0069; A63B 22/16; A63B 2022/0025; A63B 2022/0033; A63B 2022/0074; A63B 23/0429; A63B 23/0458; A63B 23/08; A63B 23/085; A63B 23/10; A63B 2023/0447; A63B 2023/0452; A63B 21/02; A63B 21/023; A63B 21/0407; A63B 21/0435; A63B 21/055; A63B 21/00189

USPC ..... 482/52, 53, 79, 80

See application file for complete search history.

(56) References Cited

U.S. PATENT DOCUMENTS

| | | | | |
|---|---|---|---|---|
| 4,563,001 A * | 1/1986 | Terauds | ..... | A63B 21/00072 482/112 |
| 5,232,421 A * | 8/1993 | Chen | ..... | A63B 22/0056 482/53 |
| 5,246,410 A * | 9/1993 | Fun | ..... | A63B 22/0056 482/112 |
| 6,315,697 B1 * | 11/2001 | Chen | ..... | A63B 22/0056 482/146 |

(Continued)

*Primary Examiner* — Loan H Thanh
*Assistant Examiner* — Gregory Winter
(74) *Attorney, Agent, or Firm* — CKC & Partners Co., Ltd.

(57) ABSTRACT

A stepper includes a base, a linking rod, two pedals and two mechanisms. The linking rod is disposed on the base. Each of the adjusting mechanism includes a blocking member, an adjusting base and an eccentric member. The blocking member includes a first blocking surface. The adjusting base is disposed on the base. The eccentric member is rotatably disposed on the adjusting base and includes at least two second blocking surfaces. The two second blocking surfaces selectively resist the first blocking surface. When one of the pedals is lowered, one of the first blocking surfaces and one of the second blocking surfaces are inclined to link up one end of the linking rod, and the other end of the linking rod is concentrically rotated, and the other first blocking surface is resisted by the other second blocking surface, thereby rotating and raising the other pedal.

6 Claims, 25 Drawing Sheets

(56) References Cited

U.S. PATENT DOCUMENTS

| | | | | |
|---|---|---|---|---|
| 7,503,879 | B2 * | 3/2009 | Liao | A63B 21/012 482/114 |
| D773,567 | S * | 12/2016 | Chuang | D21/668 |
| 2005/0272563 | A1 * | 12/2005 | Liang | A63B 21/00 482/53 |
| 2007/0219060 | A1 * | 9/2007 | Liang | A63B 22/0056 482/52 |
| 2016/0151662 | A1 * | 6/2016 | Lo | A63B 21/026 482/52 |

* cited by examiner

STEPPER

RELATED APPLICATIONS

The application claims priority to Taiwan Application Serial Number 104204233, filed on Mar. 20, 2015, which is herein incorporated by reference.

BACKGROUND

Technical Field

The present disclosure relates to a stepper. More particularly, the present disclosure relates to a stepper capable of adjusting a pedal stroke and a swing angle.

Description of Related Art

Owing to the changes of job types, most people do static indoor jobs, and the jobs requiring physical labors have been replaced by automatic machines. Therefore, the muscles of the human body may lack of exercise, thus resulting in long-term adverse effects on health.

In view of this, indoor fitness equipment is presented to the market for allowing people to do exercise anytime and anywhere, in which a stepper is used to mimic stair climbing or walking uphill to train foot muscles, thereby reaching the purpose of working out and obtaining a healthy body.

However, a conventional stepper has complicated linking structure, the working paths of the left pedal and the right pedal are fixed, and thus the pedal stroke and the swing angle cannot be adjusted. Therefore, the conventional stepper cannot meet requirements of different users.

SUMMARY

According to one aspect of the present disclosure, a stepper is provided. The stepper includes a base, a linking rod, two pedals and two adjusting mechanisms. The linking rod is disposed on the base, wherein the linking rod includes two ends that are concentrically rotated with each other. Each of the pedals includes a pedal member and a pedal arm. The pedal arm is connected to the pedal member, wherein the pedal arm is pivotally connected to one end of the linking rod for reciprocately raising or lowering the pedal member. Each of the adjusting mechanism includes a blocking member, an adjusting base and an eccentric member. The blocking member is disposed on the pedal arm, and the blocking member includes a first blocking surface. The adjusting base is disposed on the base. The eccentric member is disposed on the adjusting base and is rotatable around an axial center. The eccentric member includes at least two second blocking surfaces, and the two second blocking surfaces are separated from the axial center by different distances, and the two second blocking surfaces selectively resist the first blocking surface. When one of the pedals is lowered, one of the first blocking surfaces and one of the second blocking surfaces are inclined to link up one end of the linking rod, and the other end of the linking rod is concentrically rotated, and the other first blocking surface is resisted by the other second blocking surface, thereby rotating and raising the other pedal.

According to another aspect of the present, a stepper is provided. The stepper includes a base, a linking rod, two pedals, and two adjusting mechanisms. The linking rod is disposed on the base, wherein the linking rod includes two ends that are concentrically rotated with each other. Each of the pedals includes a pedal member and a pedal arm. The pedal arm is connected to the pedal member, wherein the pedal arm is pivotally connected with one end of the linking rod for reciprocately raising or lowering the pedal member. Each of the adjusting mechanism includes a blocking member, an adjusting base and an eccentric member. The blocking member is disposed on the pedal arm, and the blocking member includes a first blocking surface. The adjusting base is disposed on the base. The eccentric member is disposed on the adjusting base and is rotatable around an axial center. The eccentric member includes a second blocking surface, and the second blocking surface selectively resists the first blocking surface of the blocking member. The adjusting member is disposed on the adjusting base for adjusting a rotating angle or a position of the eccentric member. When one of the pedals is lowered, one of the first blocking surfaces and one of the second blocking surfaces are inclined to link up one end of the linking rod, and the other end of the linking rod is concentrically rotated, and the other first blocking surface is resisted by the other second blocking surface, thereby swinging and raising the other pedal.

BRIEF DESCRIPTION OF THE DRAWINGS

The present disclosure can be more fully understood by reading the following detailed description of the embodiment, with reference made to the accompanying drawings as follows.

DETAILED DESCRIPTION

Figure 1:
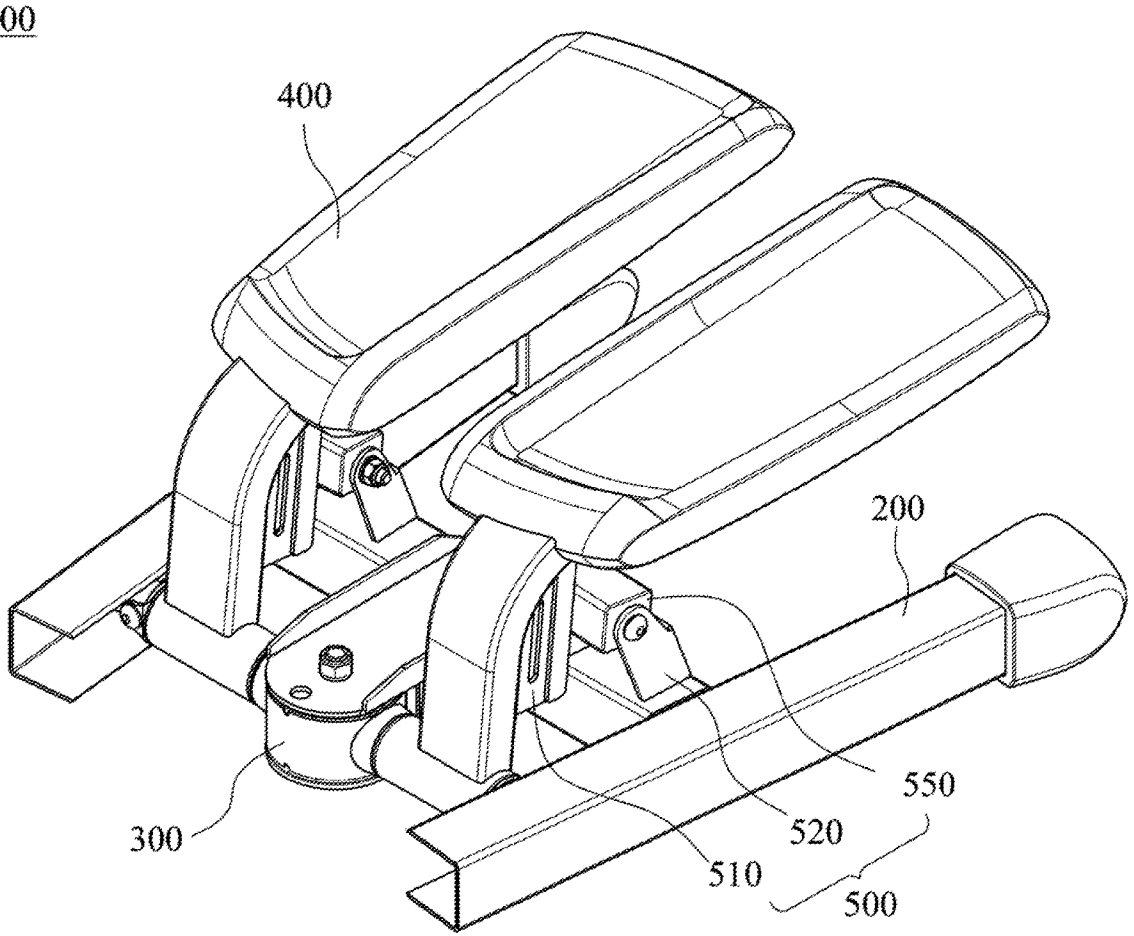
FIG. 1 is a three-dimensional view showing a stepper according to one embodiment of the present disclosure.

Reference will now be made in detail to the present embodiments of the disclosure, examples of which are illustrated in the accompanying drawings. Wherever possible, the same reference numbers are used in the drawings and the description to refer to the same or like parts.

The present disclosure provides a stepper being capable of adjusting the pedal stroke, the swing amplitude, and the swing angle that are un-adjustable in a conventional stepper. Therefore, the stepper of the present disclosure can be adjusted to meet requirements of different users.

Figure 2:
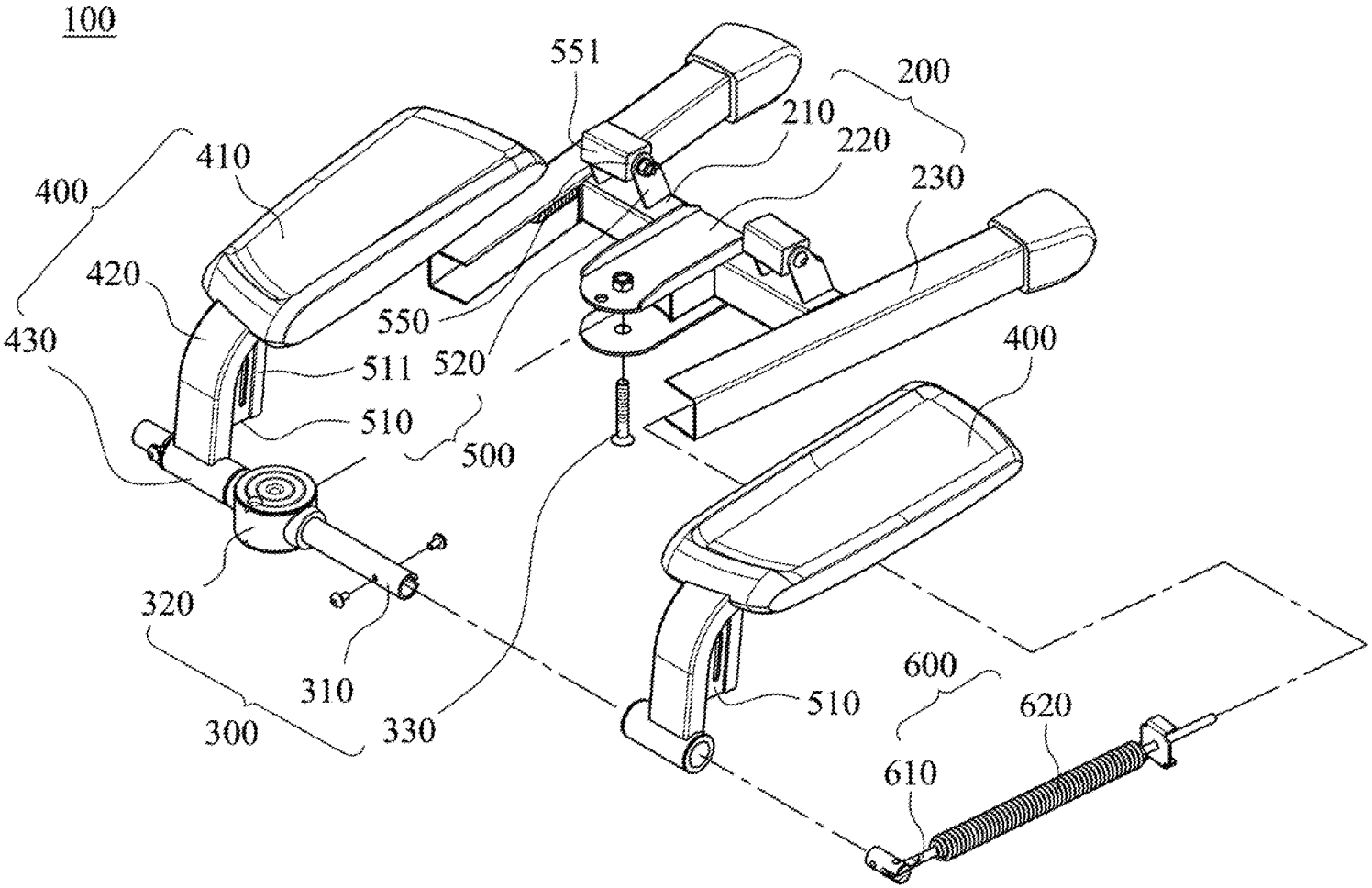
FIG. 2 is an exploded view of the stepper of FIG. 1.
Figure 3:
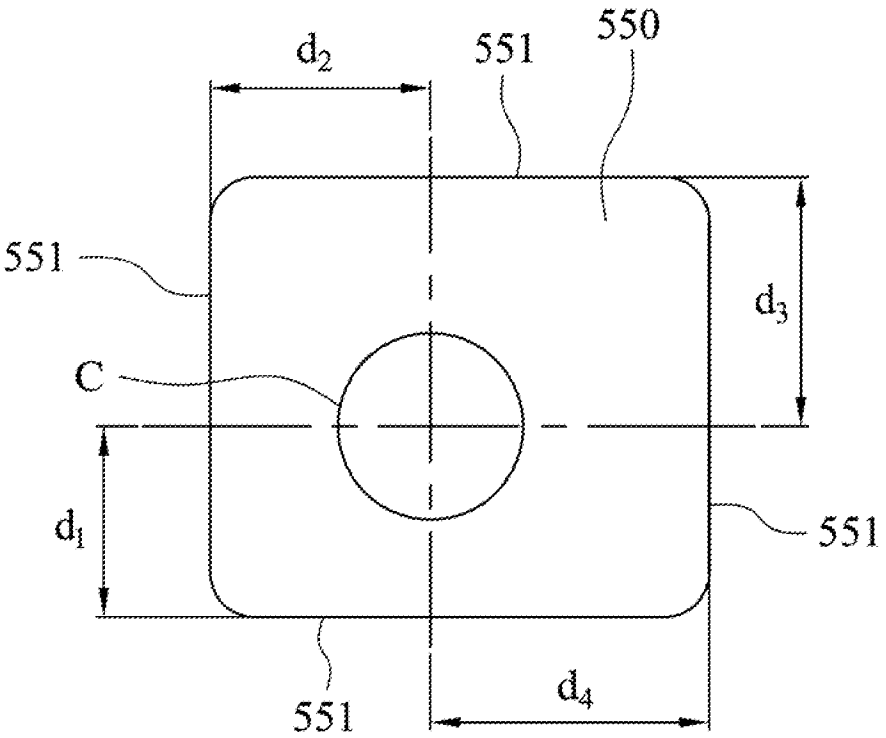
FIG. 3 is a side view of the stepper of FIG. 1.

FIG. 1 is a three-dimensional view showing a stepper 100 according to one embodiment of the present disclosure; FIG. 2 is an exploded view of the stepper 100 of FIG. 1; and FIG. 3 is a side view of the stepper 100 of FIG. 1. The stepper 100 includes a base 200, a linking rod 300, two pedals 202, two adjusting mechanisms 500 and two recovering mechanisms 600.

The base 200 is stably placed on a plane. The base 200 includes a central portion 210, an extension portion 220 and two side portions 230. The extension portion 200 is extended vertically and outwardly from the central portion 210. The two side portions 230 are connected to two ends of the central portion 210 respectively, and the two side portions 230 are hollow and are arranged in a shape of splayed arch.

The linking rod 300 is pivotally disposed on the base 200, and the liking rod 300 includes two ends 310 that are concentrically rotated with each other and a circle center portion 320. The circle center portion 320 is located at the center of the linking rod 300, and the circle center portion 320 is pivotally connected to an outer end of the extension portion 220 by a pivot axis 330, thereby rotating the linking rod 300 relative to the base 200.

Each of the pedals 400 includes a pedal member 410, a pedal arm 420 and a pivoting portion 430. The pedal member 410 is used for stamping. The pedal arm 420 is "L" shaped and is connected to the pedal member 410. The pivoting portion 430 is integrally connected to the pedal arm 420, and each of the pivoting portions 430 is pivotally connected to two ends 310 of the linking rod 300, such that the pedal arm 420 can be rotated relative to the linking rod 300 for reciprocately raising or lowering the pedal member 410.

Each of the adjusting mechanisms 500 includes a blocking member 510, an adjusting base 520 and an eccentric member 550. Two blocking members 510 are disposed on the two pedal arms 420 respectively. The blocking member 510 includes a first blocking surface 511. In the embodiment, the first blocking surface 511 can be an arc surface, and the first blocking surface 511 can be made from elastic material. The adjusting base 520 is disposed on the central portion 210 of the base 200. Each of the eccentric members 500 is disposed on the adjusting base 520 and is rotated around an axial center C. The eccentric member 550 includes at least two second blocking surfaces 551 for resisting the first blocking surface 511 of the blocking member 510. In the embodiment, the eccentric member 550 includes four second blocking surfaces 551.

Each of the recovering mechanisms 600 is located at the two side portions 230. Each of the recovering mechanism 600 is connected to two ends 310 of the linking rod 300 and the base 200. In this embodiment, the recovering mechanism 600 includes a connecting bar 610 and a tension spring 620. One end of the connecting bar 610 is connected to one end 310 of the linking rod 300, and the other end of the connecting bar 610 is connected to the tension spring 620. The recovering force can also be provided by using a compression spring, a steel cable, a pneumatic cylinder or an oil cylinder.

When the pedal 400 is stamped, the first blocking surface 511 of the blocking member 510 disposed on the pedal 400 is resisted by the second blocking surface 551 of the eccentric member 550, and thus two ends 310 of the linking rod 300 are concentrically rotated. Meanwhile, the first blocking surface 511 of the other blocking member 510 is resisted by the second blocking surface 551 of the other eccentric member 550, thereby raising the other pedal 400. Therefore, the left pedal 400 or the right pedal 400 can be moved up and down through concentrically rotating the linking rod 300 and resisting the blocking member 510 and the eccentric member 550.

Figure 4A:
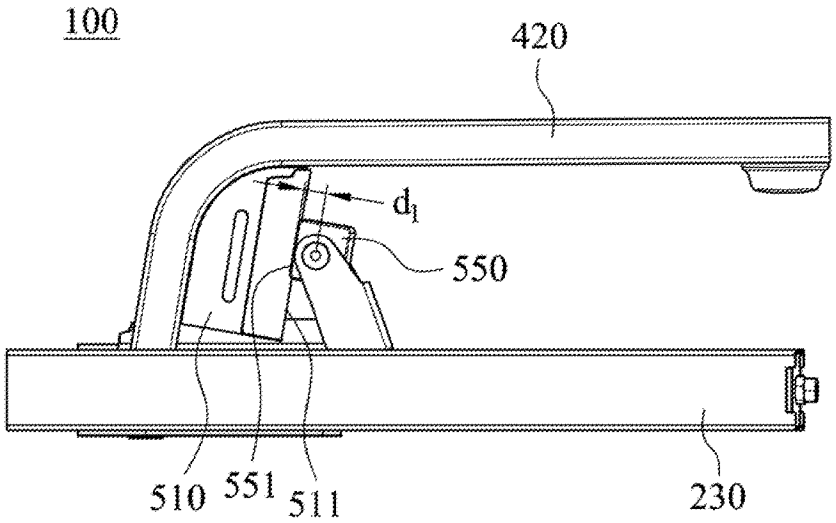
FIG. 4A is a schematic view showing a first distance between a second blocking surface and an axial center of FIG. 3.
Figure 4B:
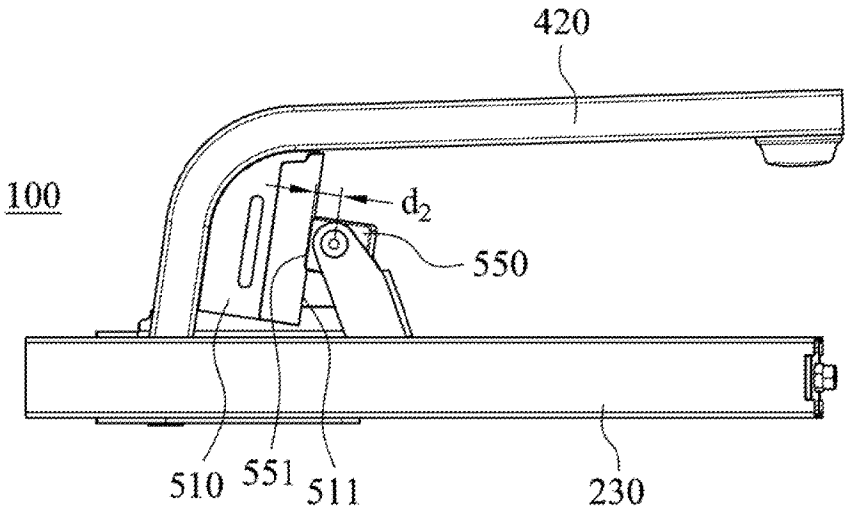
FIG. 4B is a schematic view showing a second distance between the second blocking surface and the axial center of FIG. 3.
Figure 4C:
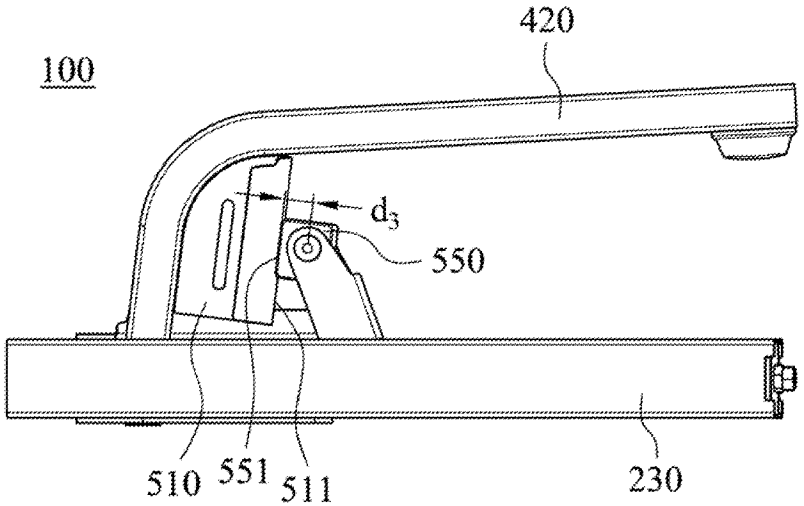
FIG. 4C is a schematic view showing a third distance between the second blocking surface and the axial center of FIG. 3.
Figure 4D:
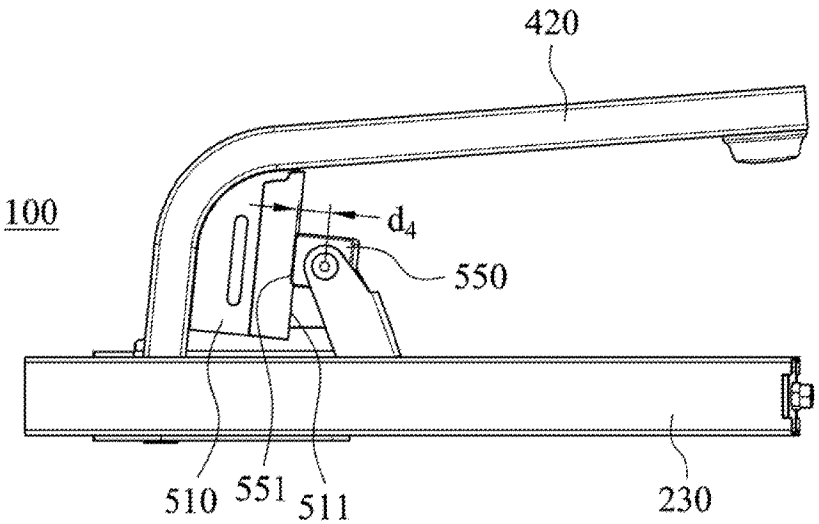
FIG. 4D is a schematic view showing a fourth distance between the second blocking surface and the axial center of FIG. 3.
Figure 5A:
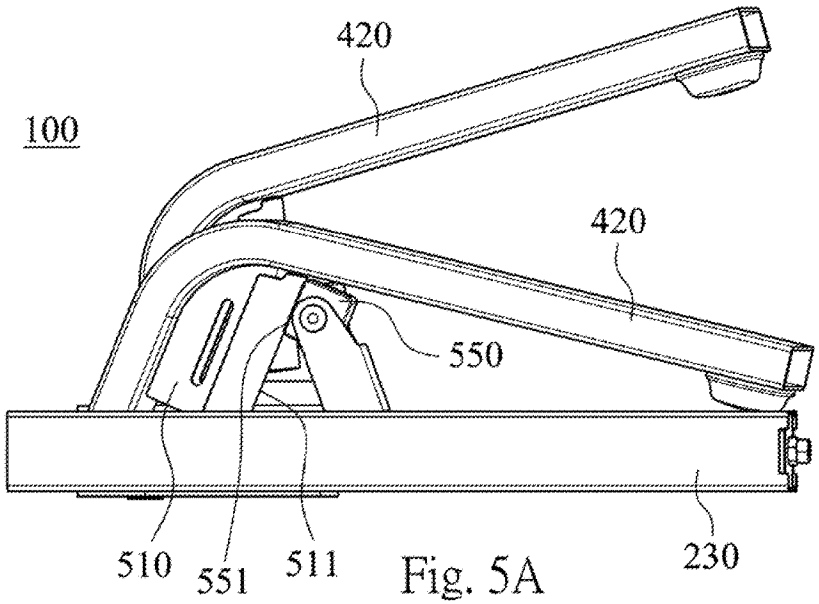
FIG. 5A is a schematic view showing an operation of the stepper of FIG. 4A.
Figure 5B:
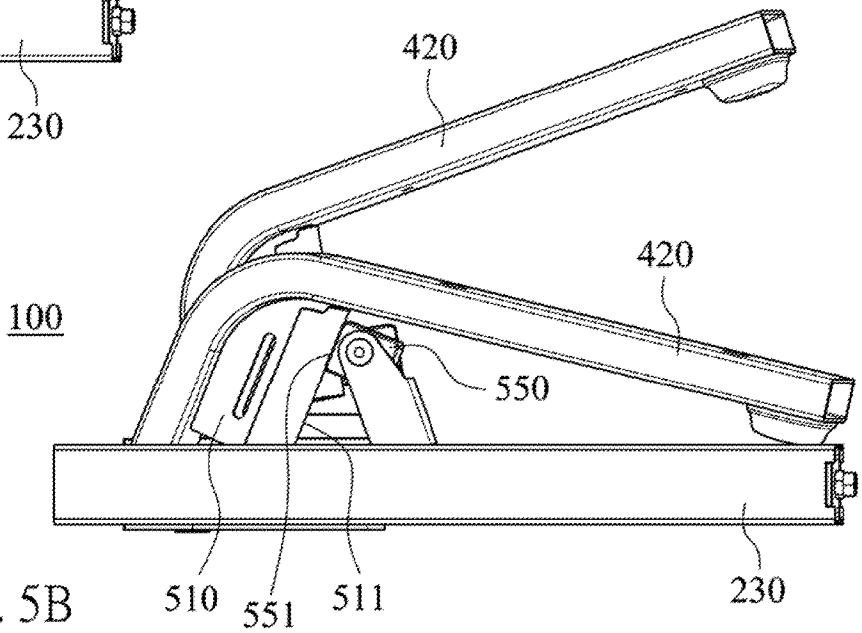
FIG. 5B is a schematic view showing an operation of the stepper of FIG. 4B.
Figure 5D:
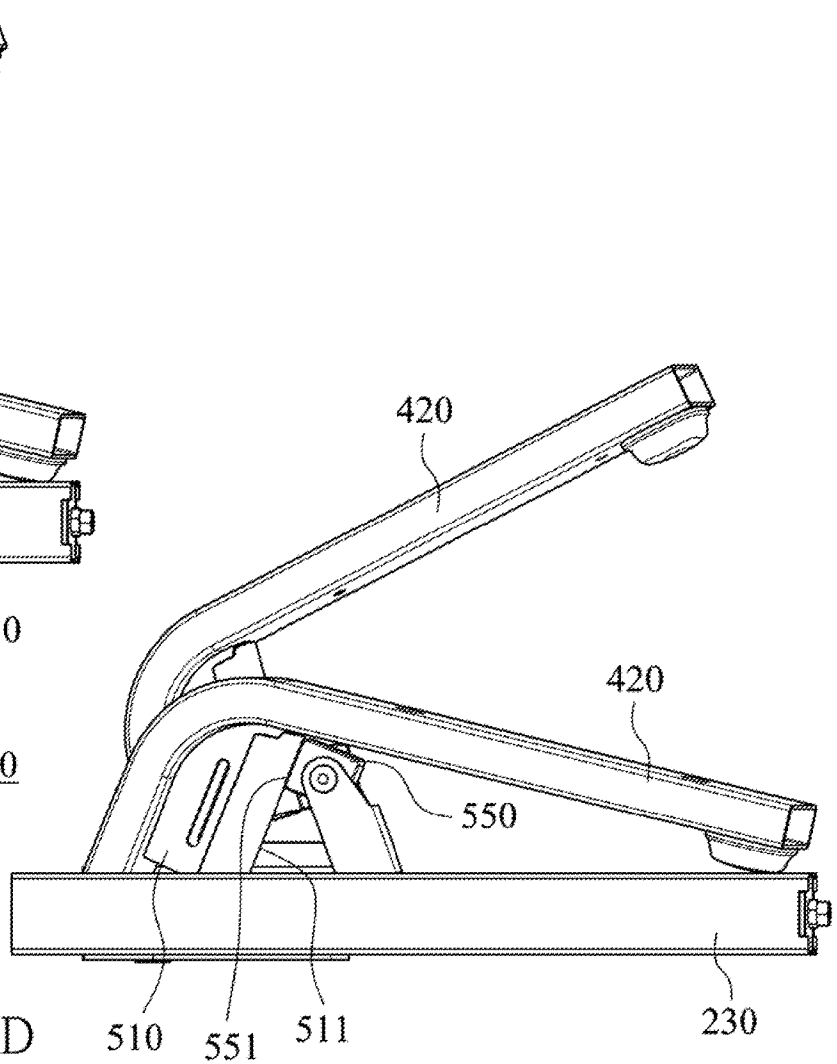
FIG. 5D is a schematic view showing an operation of the stepper of FIG. 4D.
Figure 5C:
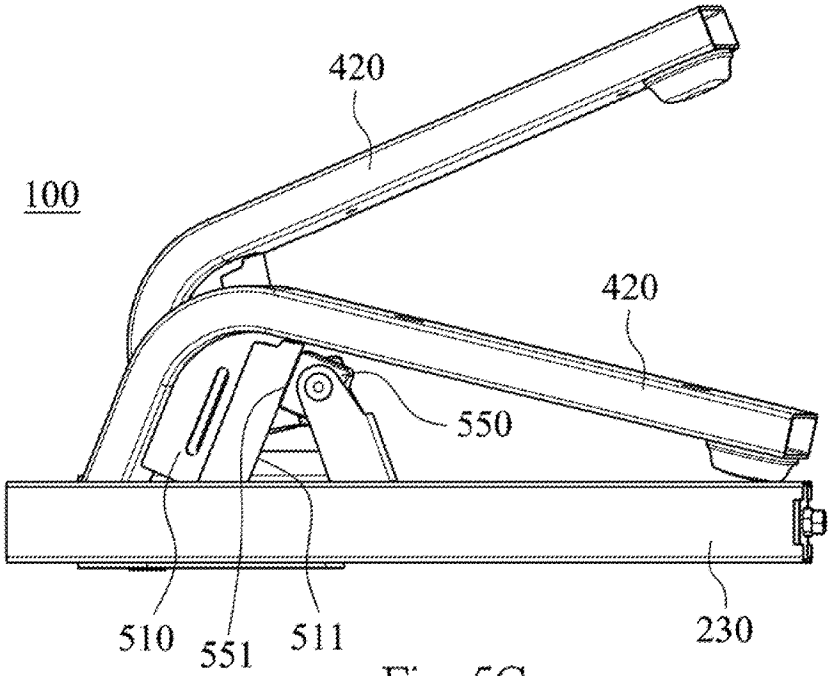
FIG. 5C is a schematic view showing an operation of the stepper of FIG. 4C.

In more detail, when different second blocking surfaces 551 corresponding to different axial distances in the eccentric member 550 are selected, the pedal stroke and the swing angle of the pedal 400 can be adjusted. Please refer to FIG. 2A, FIGS. 4A to 4D, and FIGS. 5A to 5D. FIG. 4A is a schematic view showing that a first distance d1 between the second blocking surface 551 and the axial center C; FIG. 4B is a schematic view showing that a second distance d2 between the second blocking surface 551 and the axial center C; FIG. 4C is a schematic view showing that a third distance d3 between the second blocking surface 551 and the axial center C; FIG. 4D is a schematic view showing that a fourth distance d4 between the second blocking surface 551 and the axial center C; FIG. 5A is a schematic view showing an operation of the stepper 100 of FIG. 4A; FIG. 5B is a schematic view showing an operation of the stepper 100 of FIG. 4B; FIG. 5C is a schematic view showing an operation of the stepper 100 of FIG. 4C; and FIG. 5D is a schematic view showing an operation of the stepper 100 of FIG. 4D. The pedal member is neglected and not shown in FIGS. 4A to 4D and FIGS. 5A to 5D for brief description.

In this embodiment, the number of the second blocking surfaces 551 is four, and the distances between each of the second blocking surfaces 551 and the axial center C are a first distance d1, a second distance d2, a third distance d3 and a fourth distance d4 respectively. The first distance d1 is the shortest, and the other distances are increased in sequence, and the fourth distance d4 is the longest. When the stepper 100 is operated, since the first distance d1, the second distance d2, the third distance d3 and the fourth distance d4 are different, the strokes of the pedal arm 420 are different. Therefore, in FIG. 5A, the pedal arm 420 has the smallest stroke, and by contrast, in FIG. 5D, the pedal arm 420 has the largest stroke.

Figure 6A:
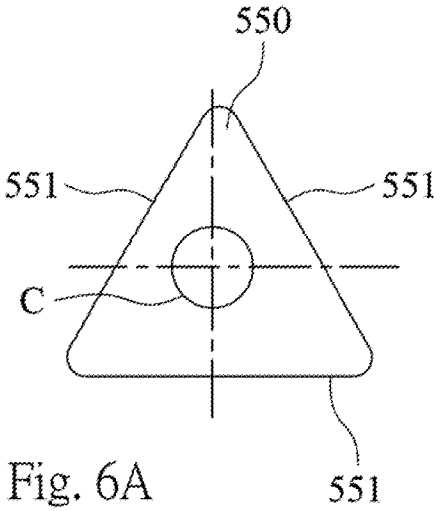
FIG. 6A is a schematic view showing that an eccentric member has three second blocking surfaces.
Figure 6C:
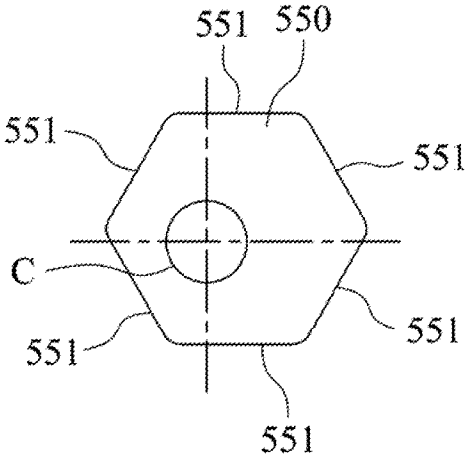
FIG. 6C is a schematic view showing that the eccentric member has six second blocking surfaces.
Figure 6B:
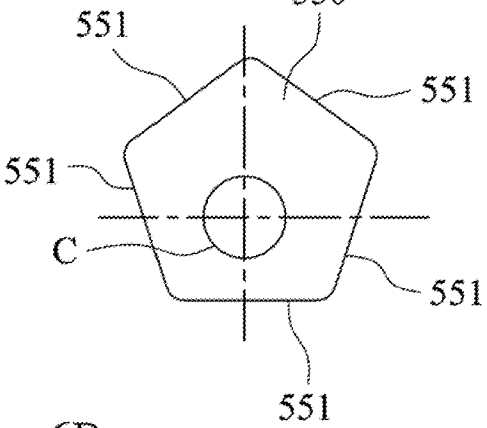
FIG. 6B is a schematic view showing that the eccentric member has five second blocking surfaces.

FIG. 6A is a schematic view showing that the eccentric member has three second blocking surfaces; FIG. 6B is a schematic view showing that the eccentric member has five second blocking surfaces; and FIG. 6C is a schematic view showing that the eccentric member has six second blocking surfaces. In FIGS. 6A to 6C, it is shown that the number of the second blocking surface 551 of the eccentric member 550 can be changed to change the pedal stroke. When the distance between the second blocking surface 551 and the axial center C is changed, not only the pedal stroke is changed, but also the swing angle is changed.

Figure 7:
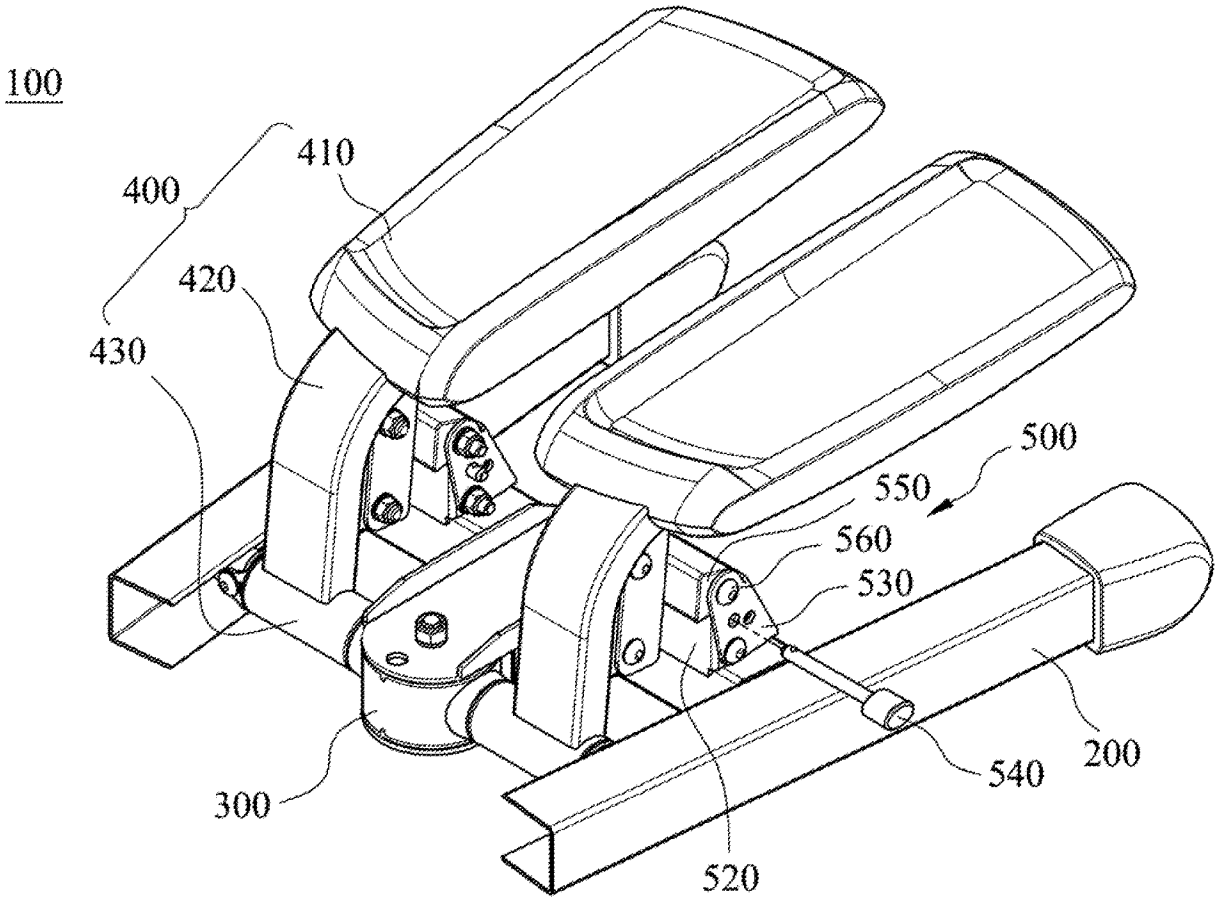
FIG. 7 is a three-dimensional view showing a stepper according to one embodiment of the present disclosure.
Figure 8:
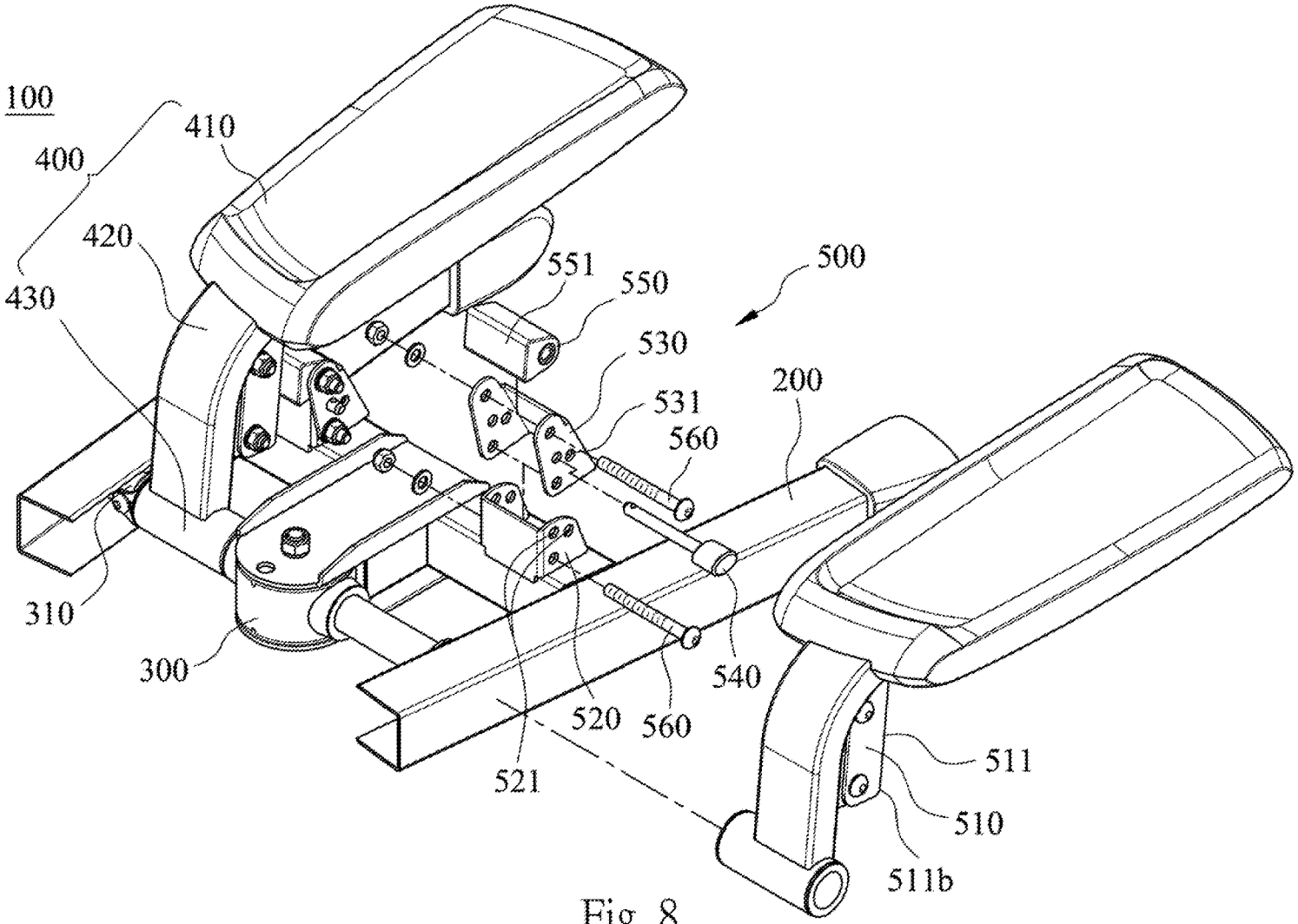
FIG. 8 is an exploded view of the stepper of FIG. 7.
Figure 9:
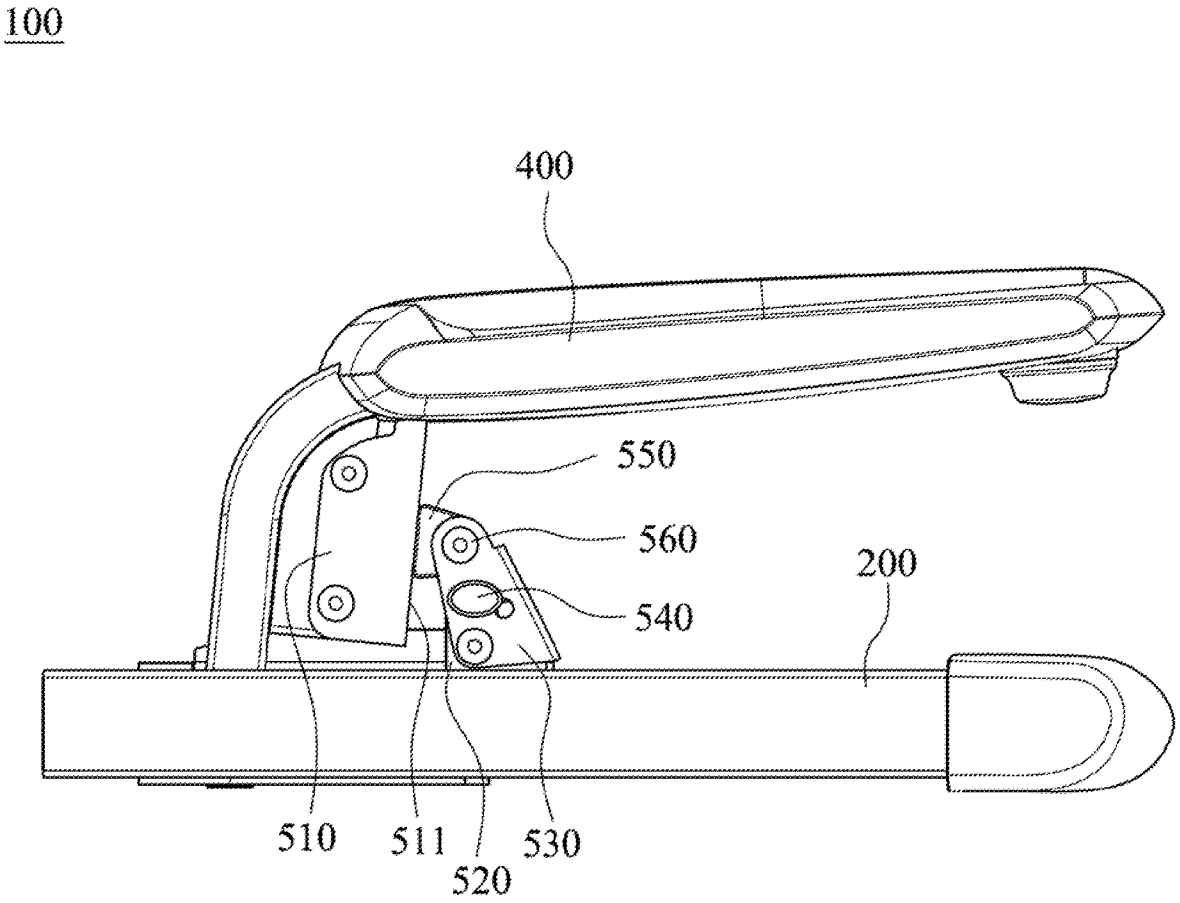
FIG. 9 is a side view of the stepper of FIG. 8.

FIG. 7 is a three-dimensional view showing a stepper 100 according to one embodiment of the present disclosure; FIG. 8 is an exploded view of the stepper 100 of FIG. 7; and FIG. 9 is a side view of the stepper 100 of FIG. 8. The stepper 100 includes a base 200, a linking rod 300, two pedals 400, and two adjusting mechanisms 500.

The base 200 is stably placed on a plane.

The linking rod 300 is pivotally disposed on the base 200, and the linking rod 200 includes two ends 310 that are concentrically rotated with each other.

Each of the pedals 400 includes a pedal member 410, a pedal arm 420 and a pivoting portion 430. The pedal member 410 is used for stamping. The pedal arm 420 is "L" shaped and is connected to the pedal member 410. The pivoting portion 430 is integrally connected to the pedal arm 420, and each of the pivoting portions 430 is pivotally connected to two ends 310 of the linking rod 300, such that the pedal arm 420 can be rotated relative to the linking rod, thereby reciprocately raising or lowering the pedal member 410.

Each of the adjusting mechanism 500 includes a blocking member 510, an adjusting base 520, an adjusting sheet 530, an adjusting member 540, an eccentric member 550 and two screws 560. The blocking members 510 is disposed on the two pedal arms 420. The blocking member 510 includes a first blocking surface 511. In the embodiment, the first blocking surface 511 can be an arc surface 511*b*, and the first blocking surface 511 can be made from elastic material. The adjusting base 520 is disposed on the base 200, and the adjusting base 520 has a plurality of adjusting holes 521. The adjusting sheet 530 has a plurality of fixing holes 531. The adjusting member 540 is actively disposed in the adjusting hole 521 of the adjusting base 520 and the fixing hole 531 of the adjusting sheet 530. The eccentric member 550 is adjustably disposed on the adjusting base 520 through the adjusting member 540, the fixing hole 531 and the adjusting hole 521. The eccentric member 550 includes a second blocking surface 551 for resisting the first blocking surface 511 of the blocking member 510. Two screws 560 are disposed through two fixing holes 531 and two adjusting holes 521, and stop the eccentric member 550 and the adjusting sheet 530. In this embodiment, the adjusting member 540 can be a bolt or a plug. The positions and the number of the adjusting hole 521, the fixing hole 531 and the screw 560 corresponding to the adjusting hole 521 and the fixing hole 531 are not limited.

Figure 10A:
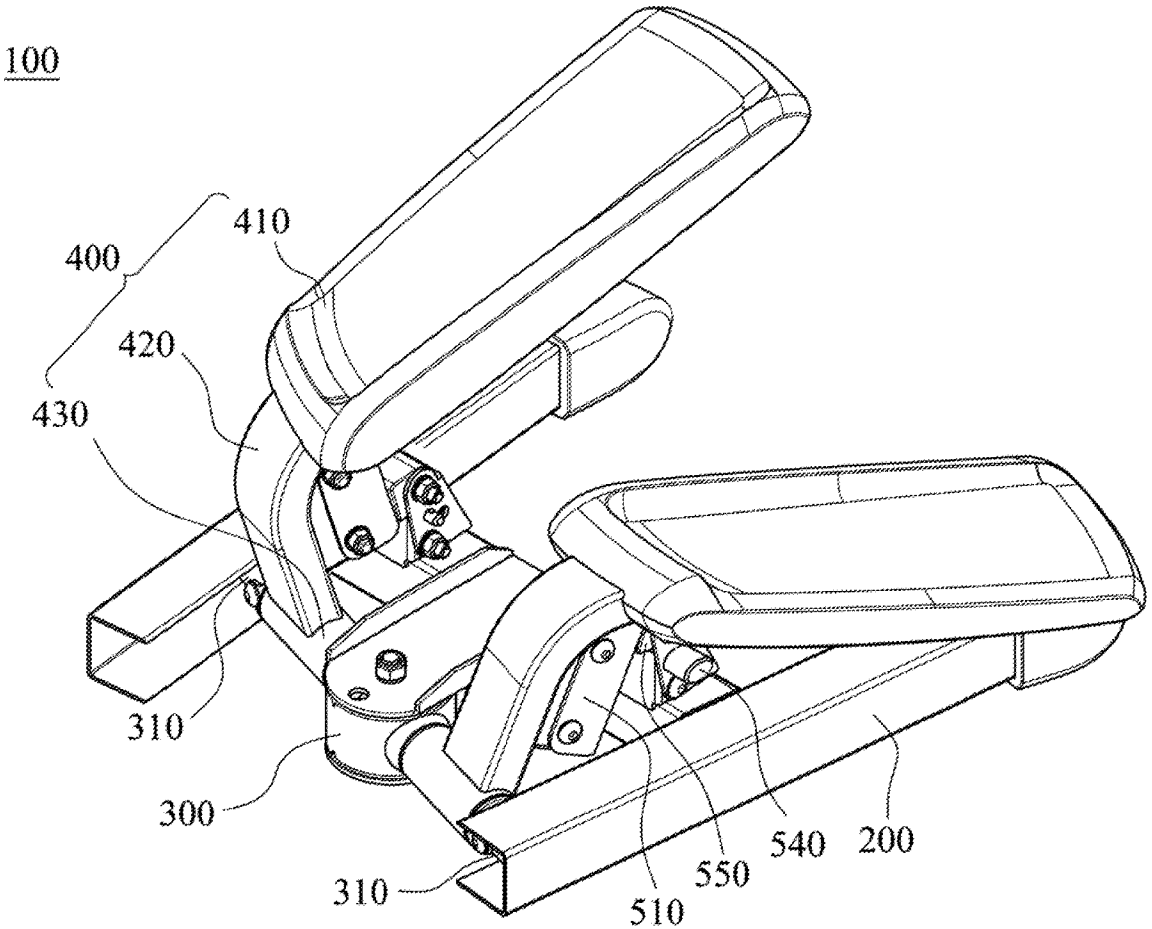
FIG. 10A is a schematic view showing an action of the stepper of FIG. 8.
Figure 10B:
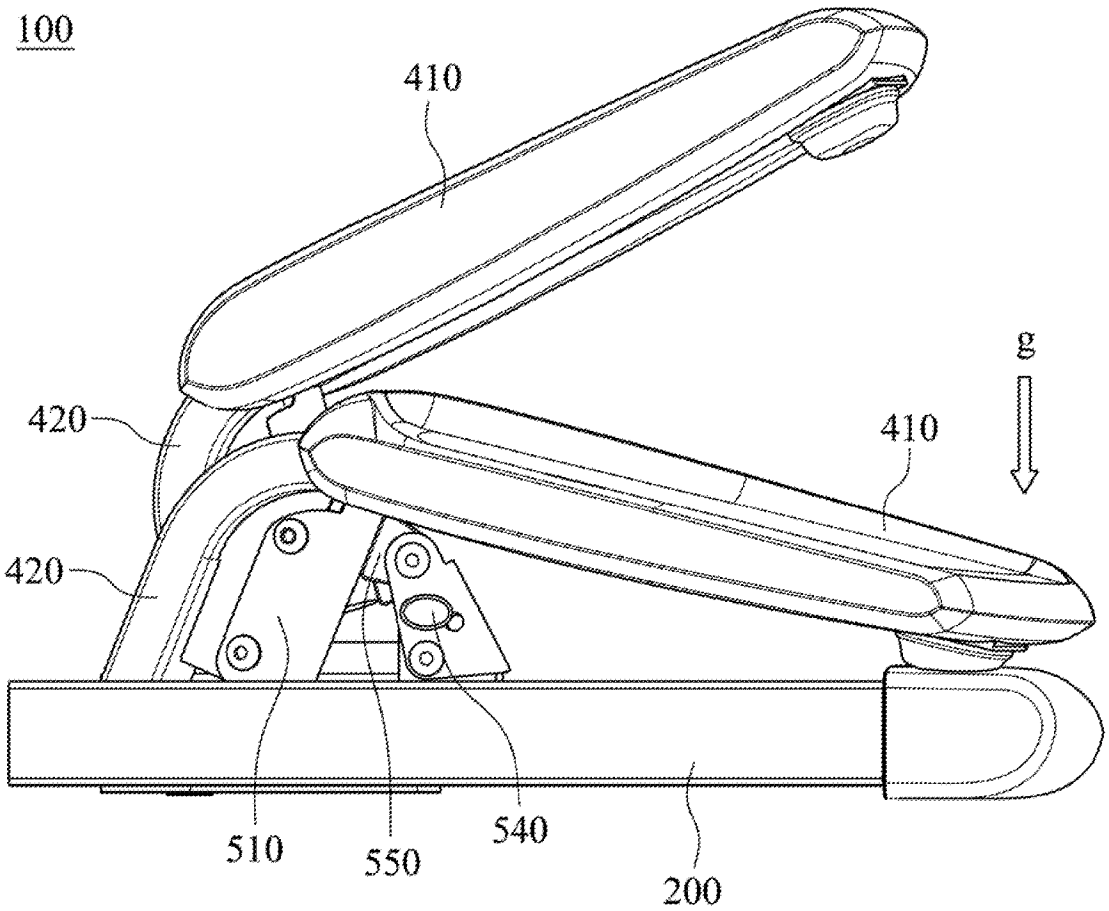
FIG. 10B is a schematic view showing an action of one side of the stepper of FIG. 10A.
Figure 10C:
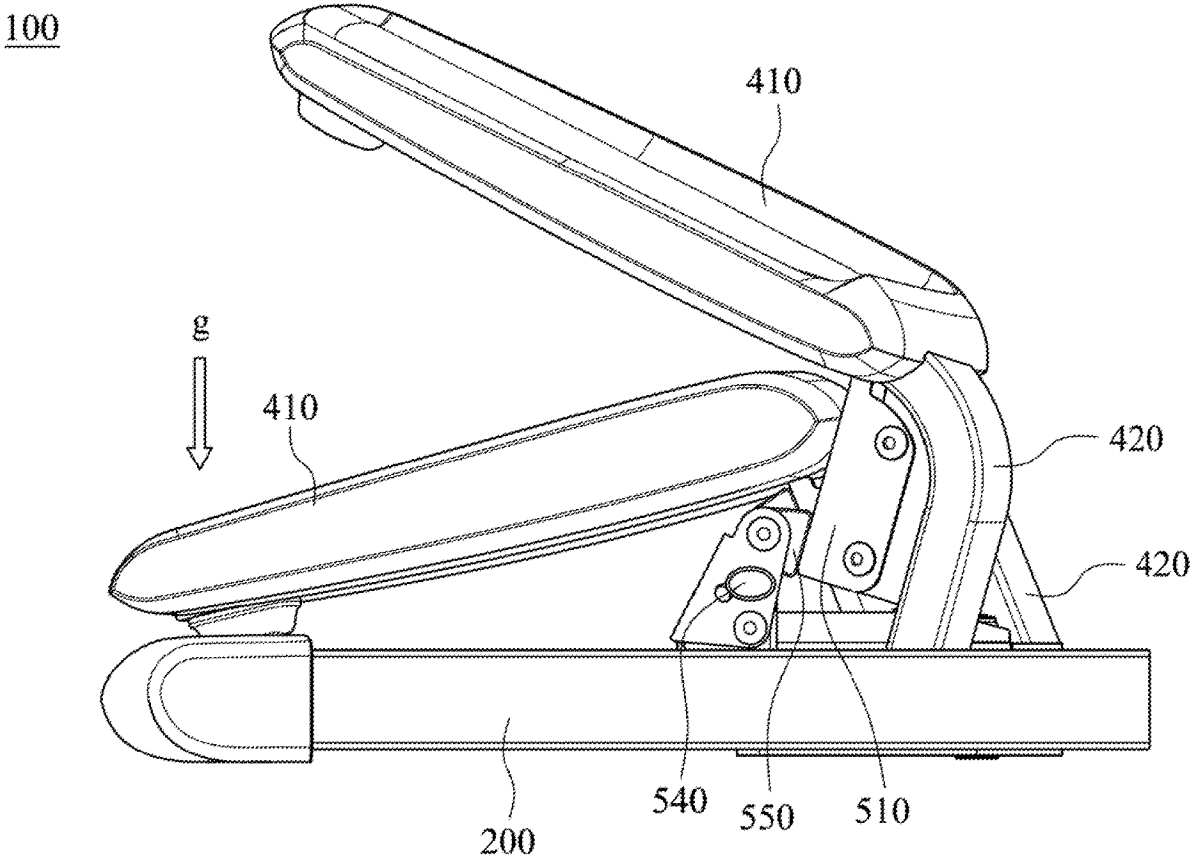
FIG. 10C is a schematic view showing an action of the other side of the stepper of FIG. 10A.

Please refer to FIG. 8 and FIGS. 10A to 10C. FIG. 10A is a schematic view showing an action of the stepper 100 of FIG. 8; FIG. 10B is a schematic view showing an action of one side of the stepper 100 of FIG. 10A; and FIG. 10C is a schematic view showing an action of the other side of the stepper 100 of FIG. 10A. The adjusting member 540 is selectively disposed through two adjusting holes 521 and two fixing holes 531, different adjusting hole 521 and fixing hole 531 will lead different inclining angles of the adjusting sheet 530 and different angles of the eccentric member 550, thereby adjusting pedal stroke and swing angle of the pedal 400. In more detail, when a pedal 400 is lowered along a gravity direction g, the first blocking surface 511 of the blocking member 510 and the second blocking surface 551 of the eccentric member 550 are inclined along the gravity direction g, thereby forcing two ends 310 of the linking rod 300 to be concentrically rotated. Meanwhile, the second blocking surface 551 of the other eccentric member 550 inclinedly resists the first blocking surface 511 of the other blocking member 511, thereby raising the other pedal 400. Therefore, the pedal 400 can swing up, down, left or right by concentrically rotating the linking rod 300 and resisting the eccentric member 550 and the blocking member 510.

It should be emphasized that, through the limitation of the eccentric member 550 and the blocking member 510, the pedal 400 can swing up, down, left, and right. Moreover, by disposing different adjusting hole 521 and fixing hole 531 through the adjusting member 540, the angle at which the eccentric member 550 resists the blocking member 510 can be adjusted for adjusting the pedal stroke and the swing angle. People may adjust the adjusting base 520, the adjusting sheet 530, the adjusting member 540, the eccentric member 550 and the screw 560 in accordance with different pedal strokes and swing angles.

Figure 11A:
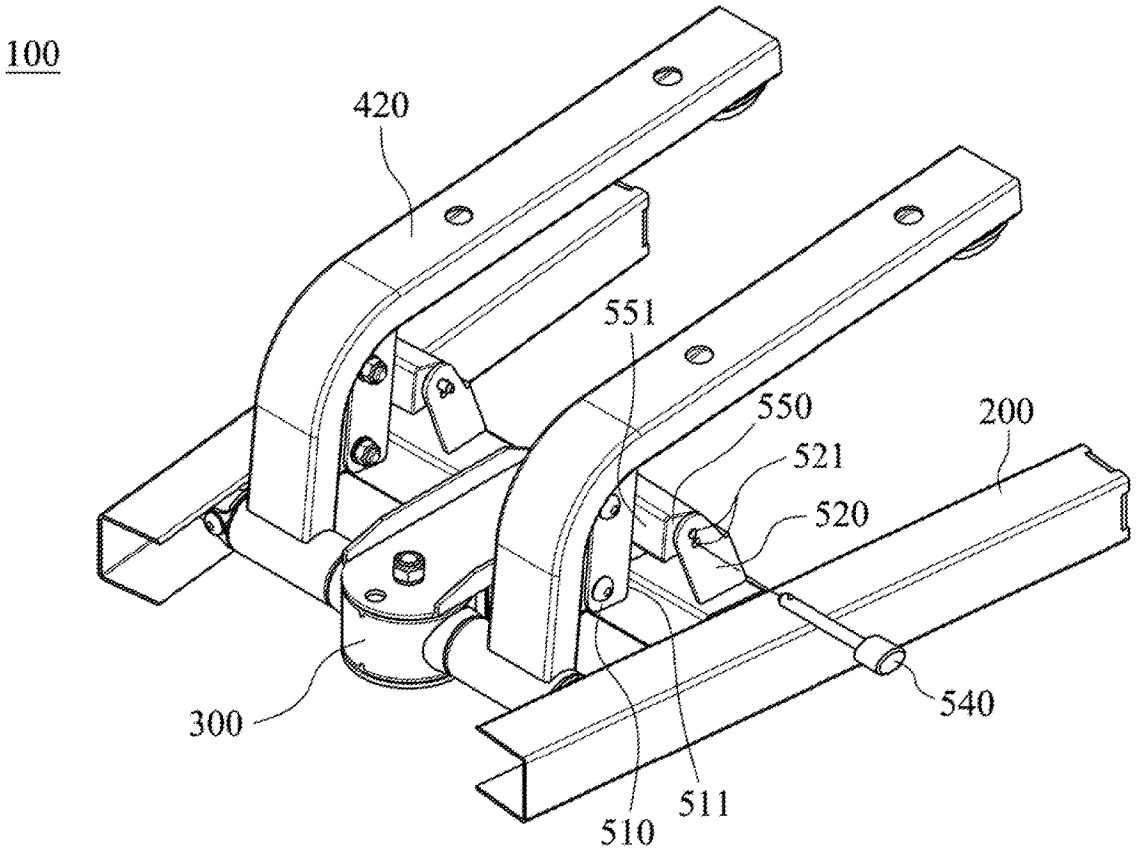
FIG. 11A is a three-dimensional view showing a stepper according to another embodiment of the present disclosure.
Figure 11B:
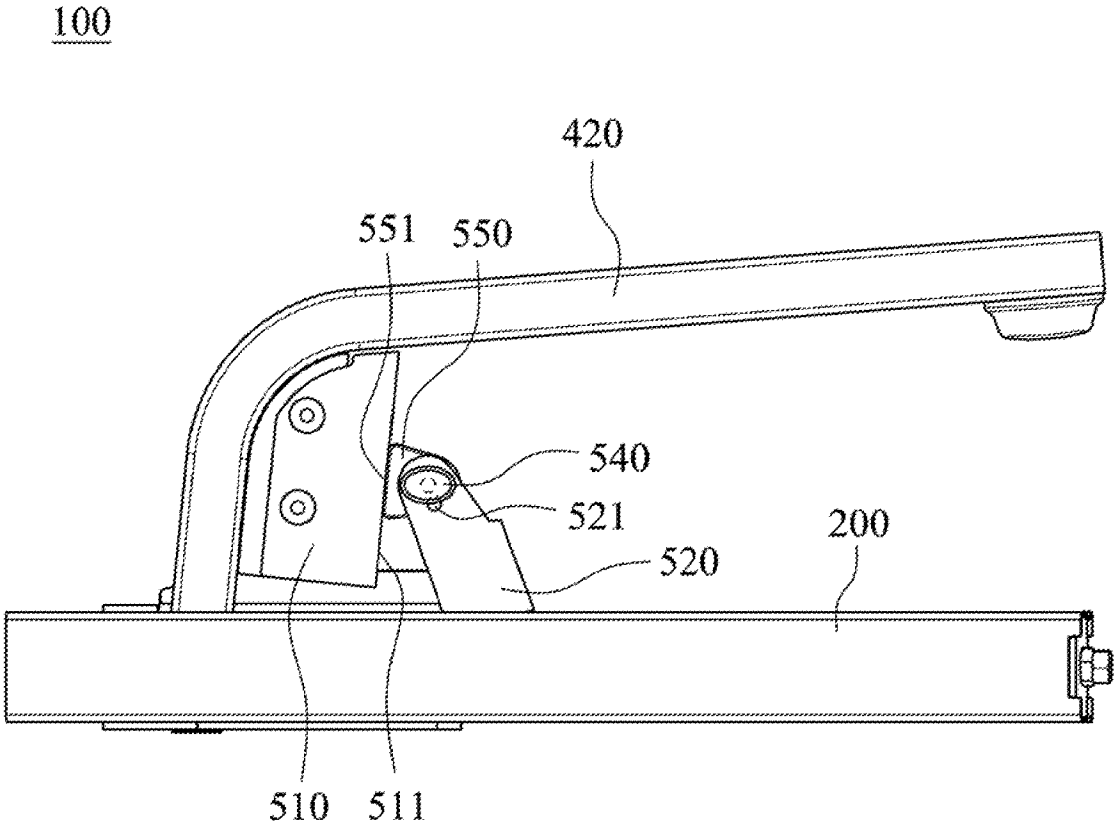
FIG. 11B is a side view of the stepper of FIG. 11A.

FIG. 11A is a three-dimensional view showing a stepper according to another embodiment of the present disclosure; and FIG. 11B is a side view of the stepper of FIG. 11A. In FIGS. 11A and 11B, the pedal member is neglected for brief description. In FIGS. 11A and 11B, the adjusting mechanism 500 removes the adjusting sheet 530 in FIG. 8, and the adjusting member 540 is directly disposed through the adjusting hole 521 of the adjusting base 520 and the eccentric member 550. Since the adjusting holes 521 are arranged in accordance with different heights, a different height position of the eccentric member 550 can be adjusted by adjusting different adjusting holes 521, thereby changing the height at which the second blocking surface 551 of the eccentric member 550 resists the first blocking surface 511 of the blocking member 510. Thus, the pedal stroke and the swing angle of the pedal arm 420 can be changed.

Figure 12A:
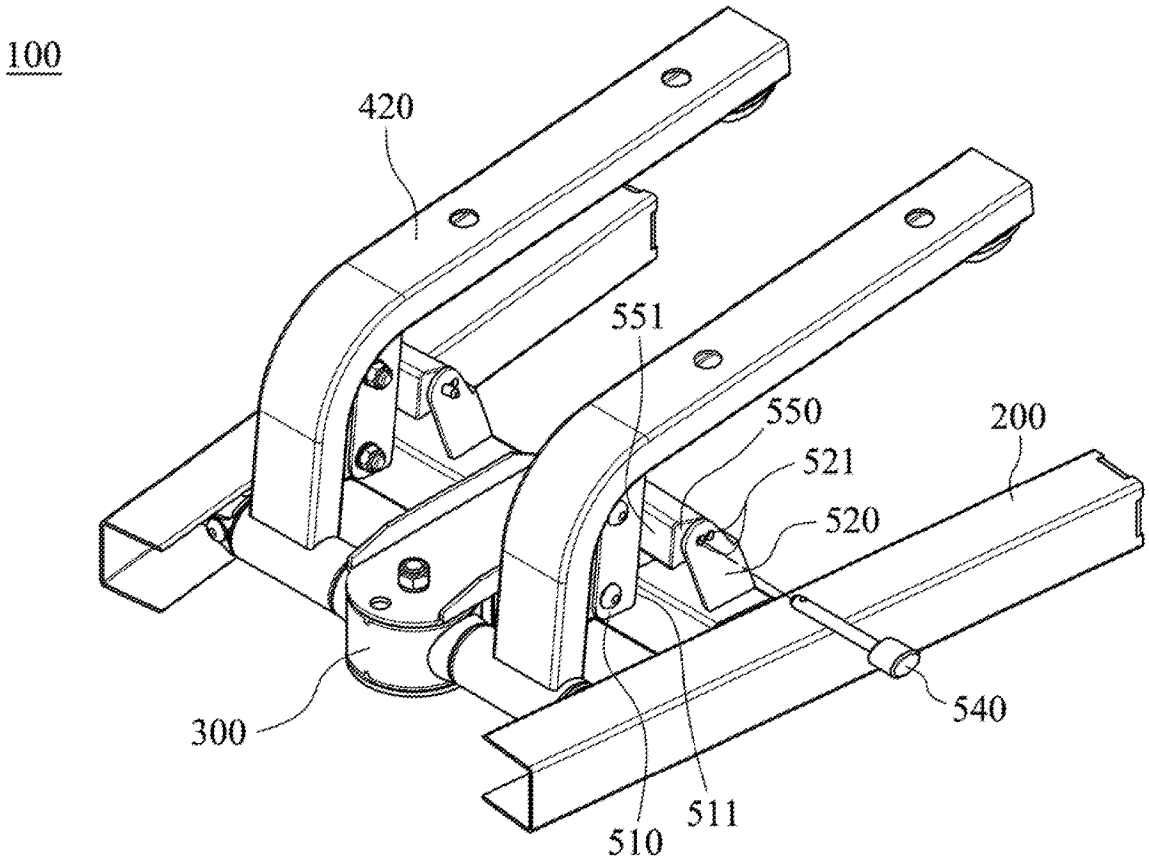
FIG. 12A is a three-dimensional view showing a stepper according to still another embodiment of the present disclosure.
Figure 12B:
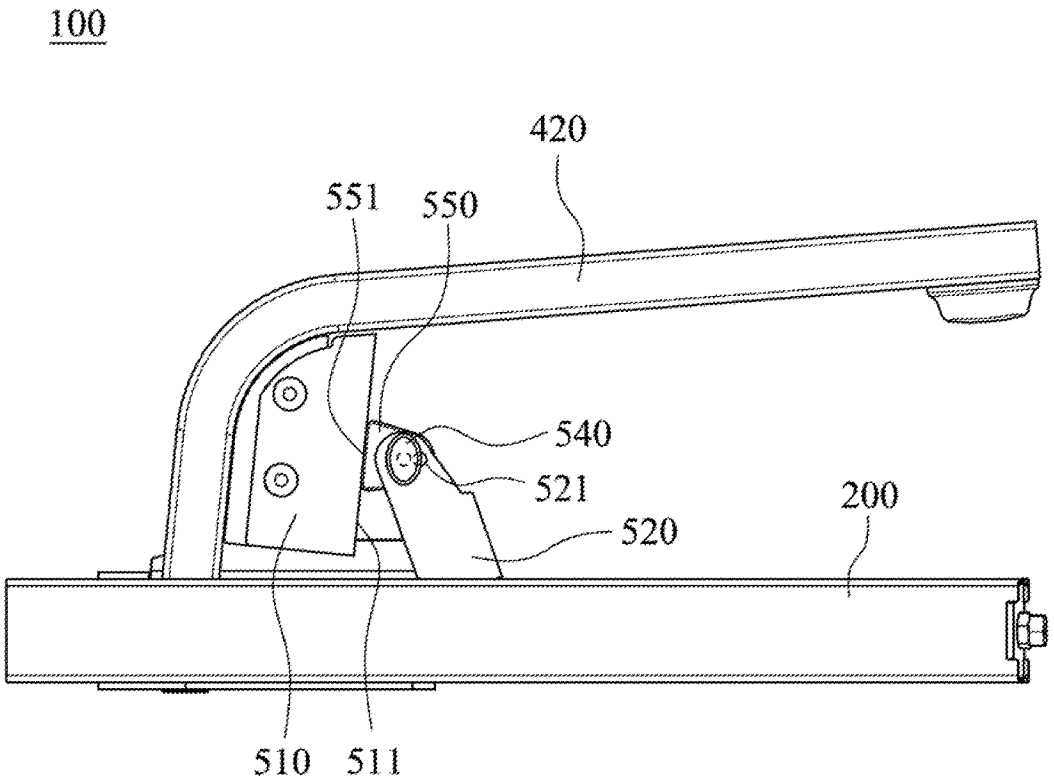
FIG. 12B is a side view of the stepper of FIG. 12A.

FIG. 12A is a three-dimensional view showing a stepper 100 according to still another embodiment of the present disclosure; and FIG. 12B is a side view of the stepper 100 of FIG. 12A. In FIGS. 11A and 11B, the adjusting mechanism 500 removes the adjusting sheet 530 in FIG. 8, and the adjusting member 540 is directly disposed through the adjusting hole 521 of the adjusting base 520 and the eccentric member 550. Since the adjusting holes 521 are arranged horizontally, different horizontal positions of the eccentric member 550 can be adjusted by adjusting different adjusting holes 521, thereby changing the distance when the second blocking surface 551 of the eccentric member 550 resists the first blocking surface 511 of the blocking member 510. Thus, the pedal stroke and the swing angle of the pedal arm 420 can be changed.

Figure 13:
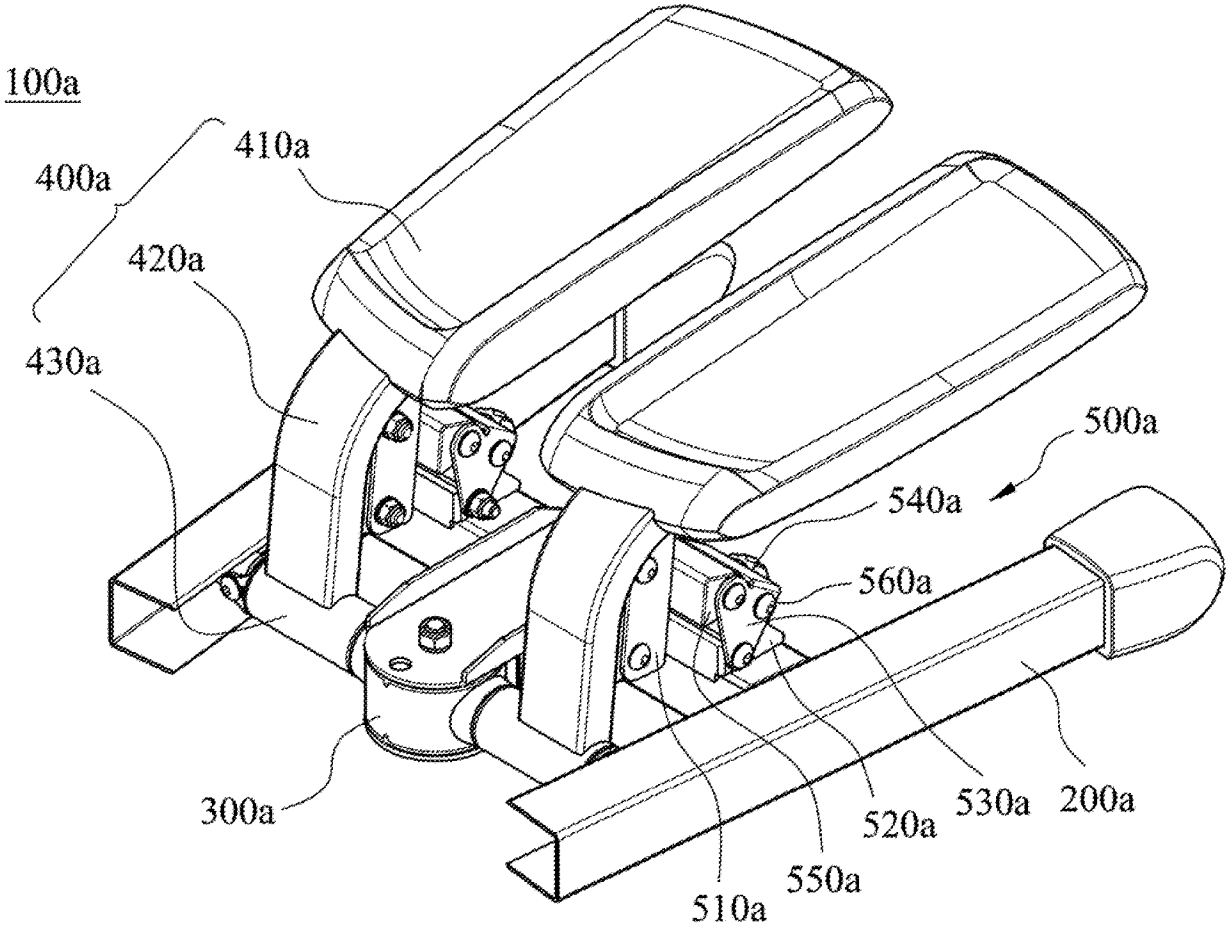
FIG. 13 is a three-dimensional view showing a stepper according to further another embodiment of the present disclosure.
Figure 14:
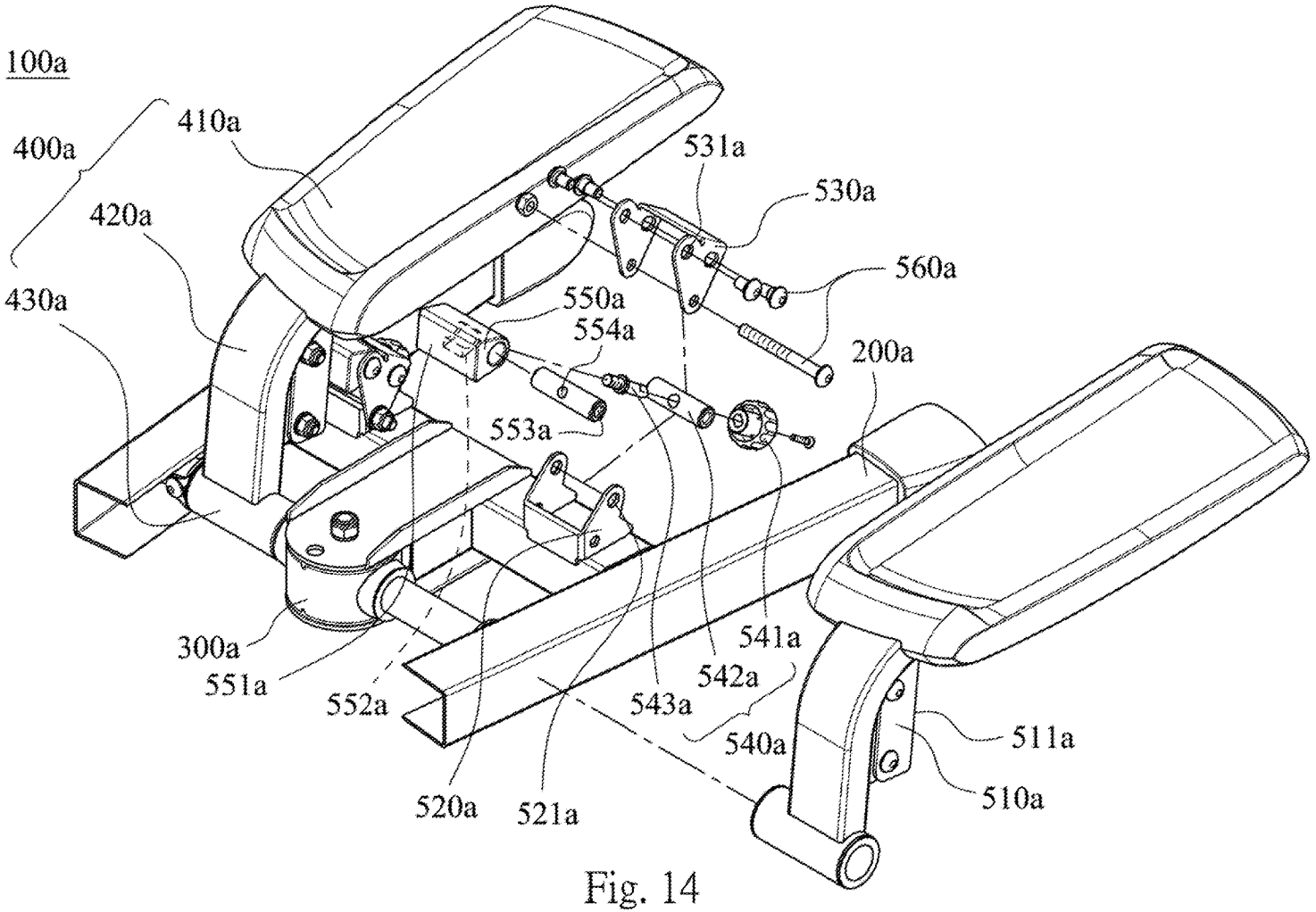
FIG. 14 is an exploded view of the stepper of FIG. 13.
Figure 15:
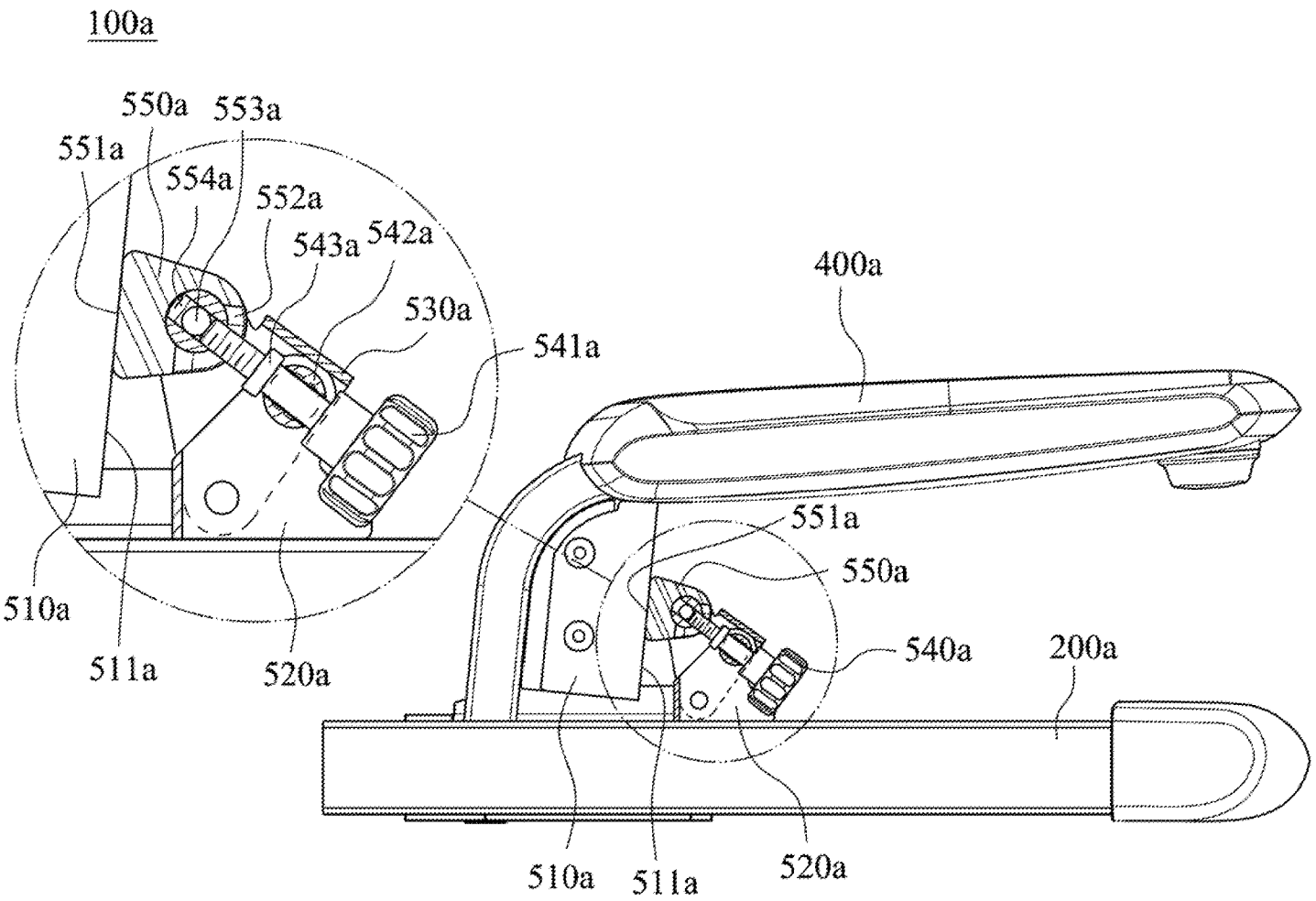
FIG. 15 is a side view of the stepper of FIG. 14.

FIG. 13 is a three-dimensional view showing a stepper 100*a* according to further another embodiment of the present disclosure; FIG. 14 is a exploded view showing the stepper 100*a* of FIG. 13; and FIG. 15 is a side view showing the stepper 100*a* of FIG. 14. In FIG. 15, the pedal member is neglected. In this embodiment, only the adjusting mechanism 500*a* is changed, the base 200*a*, the linking rod 300*a* and the two pedals 400*a* are similar to the aforementioned embodiments.

The adjusting mechanism 500*a* includes a blocking member 510*a*, an adjusting base 520*a*, an adjusting sheet 530*a*, an adjusting member 540*a*, an eccentric member 550*a* and three screws 560*a*. In this embodiment, two fixing holes 531 of the adjusting sheet 530*a* are slot shaped. The adjusting member 540*a* includes an adjusting head 541*a*, a fixing tube 542*a* and a pushing head 543*a*. The adjusting head 541*a* is rotatably connected to the pushing head 543*a* by the fixing tube 542*a*, and the pushing head 543*a* pushes against the eccentric member 550*a*. The eccentric member 550*a* includes a groove 552*a* and an axis 553*a*. The groove 552*a* is arc-like, is opened on the eccentric member 550*a*, and is correspondent to the adjusting member 540*a*. The axis 553*a* is provided for pivotally disposing the eccentric member 550*a* on the adjusting base 520*a*. The axis 553*a* opens a screw hole 554*a* at its side, and the screw hole 554*a* is used for screwing the pushing head 543*a*. Two screws 560*a* are through the fixing holes 531*a* and are screwed to the axis 553*a* of the eccentric member 550*a*. Two screws 560*a* are inserted through the adjusting holes 521*a* and two slot-shaped fixing holes 531*a*, and are screwed on two ends of the fixing tube 542*a*. The slot-shaped fixing holes 531*a* is positioned in the adjusting hole 521*a* by the screw 560*a*, and the eccentric member 550*a* is screwed by the other screws 560*a* through the other two fixing holes 531*a* of the adjusting sheet 530*a*, so as to form a swingable angle. Therefore, the rotating angle of the eccentric member 550*a* and the position of the eccentric member 550*a* can be adjusted by rotating the adjusting head 541*a* in the screw hole 554*a* of the axis 553*a*, incorporation with the slot-shaped fixing hole 531*a* and the arc-like groove. Therefore, an inclined angle of the second blocking surface 551*a* of the eccentric member 550*a* and an inclined angle of the first blocking surface 511*a* of the blocking member 520*a* can be adjusted, and thus the pedal stroke and the swing angle of the pedal 400*a* can be changed.

Figure 16A:
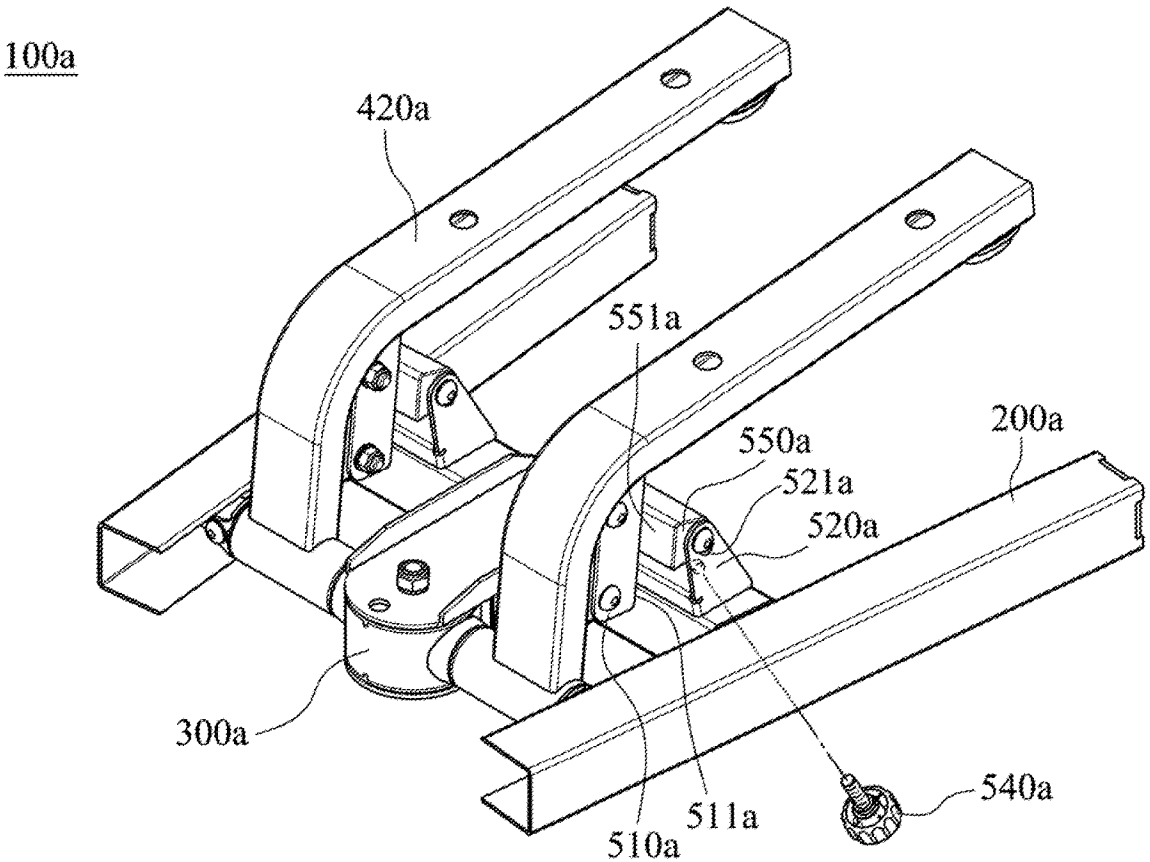
FIG. 16A is a three-dimensional view showing a stepper according to one embodiment of the present disclosure.
Figure 16B:
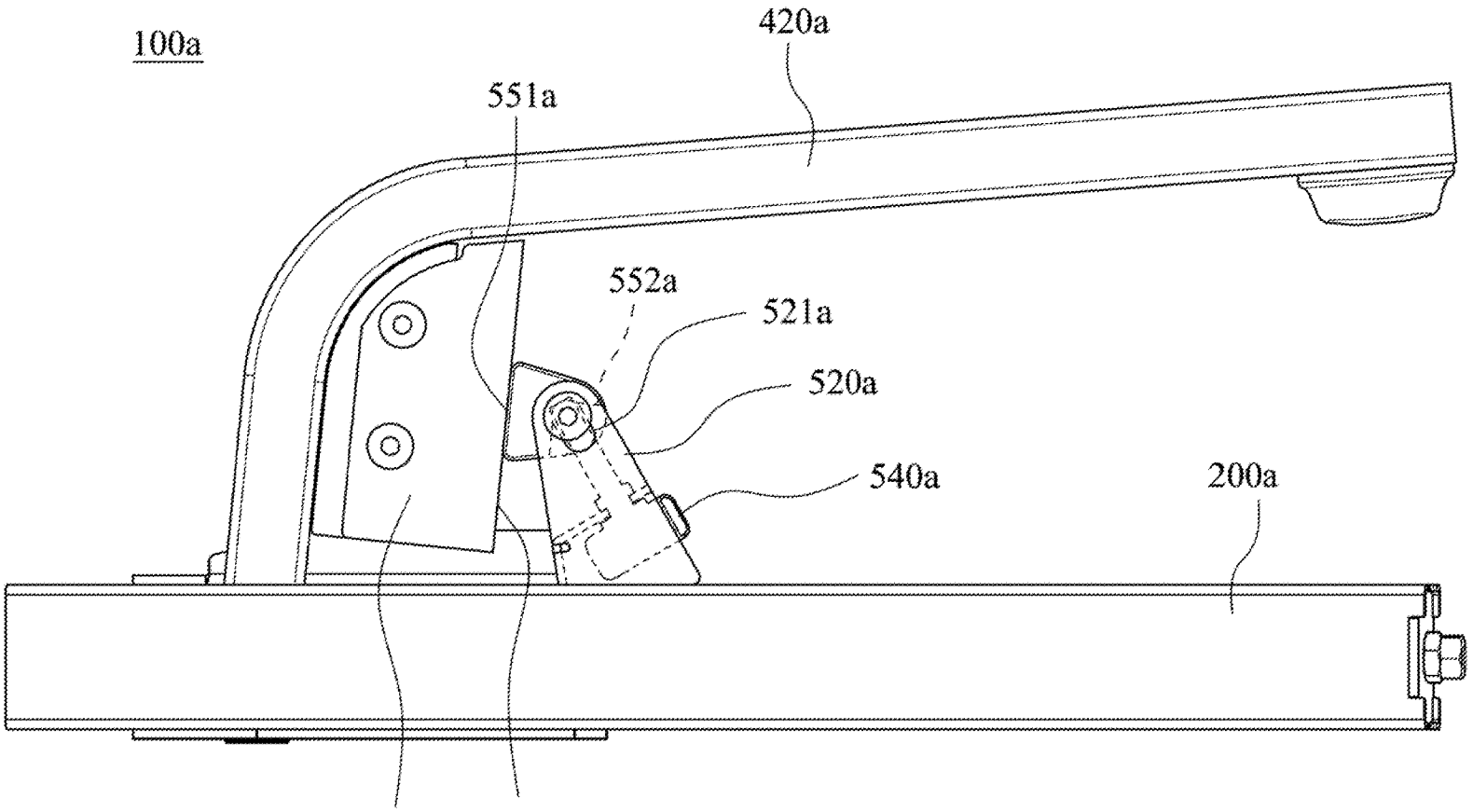
FIG. 16B is a side view of the stepper of FIG. 16A.

FIG. 16A is a three-dimensional view showing a stepper 100*a* according to one embodiment of the present disclosure; and FIG. 16B is a side view showing the stepper 100*a* of FIG. 16A. In FIGS. 16A and 16B, the adjusting sheet 530*a* (as shown in FIG. 14) is removed, and the adjusting member 540*a* is integrally constructed. The adjusting member 540*a* is inclinedly disposed on the adjusting base 520*a*. Because two of the adjusting holes 521*a* are opened along a moving direction of the adjusting member 540*a* and are elongated, the position of the eccentric member 550*a* can be adjusted by the elongated adjusting holes 521, and an inclined angle of the first blocking surface 511*a* of the blocking member 520*a* can be adjusted, and thus the pedal stroke and swing angle of the pedal 400*a* can be changed.

Figure 17A:
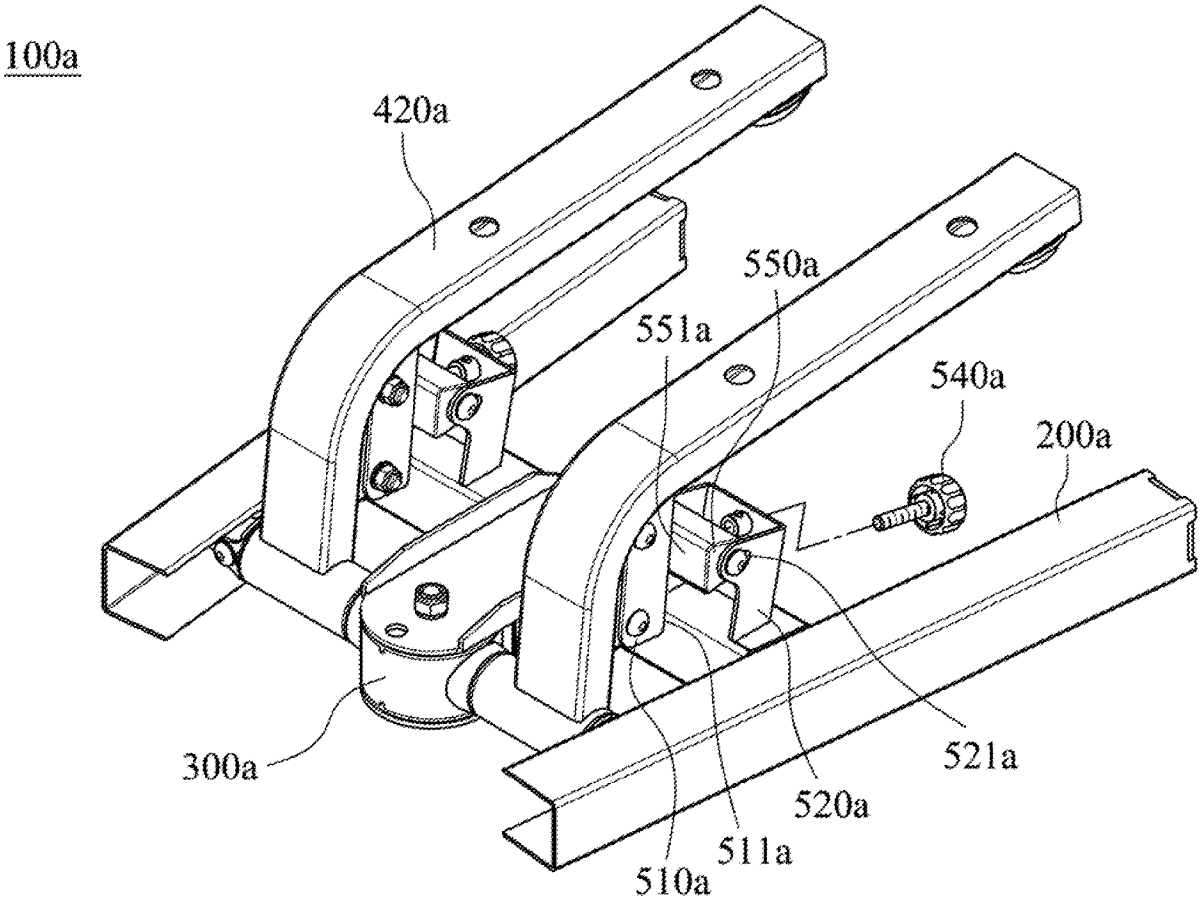
FIG. 17A is a schematic view showing a stepper according to one embodiment of the present disclosure.
Figure 17B:
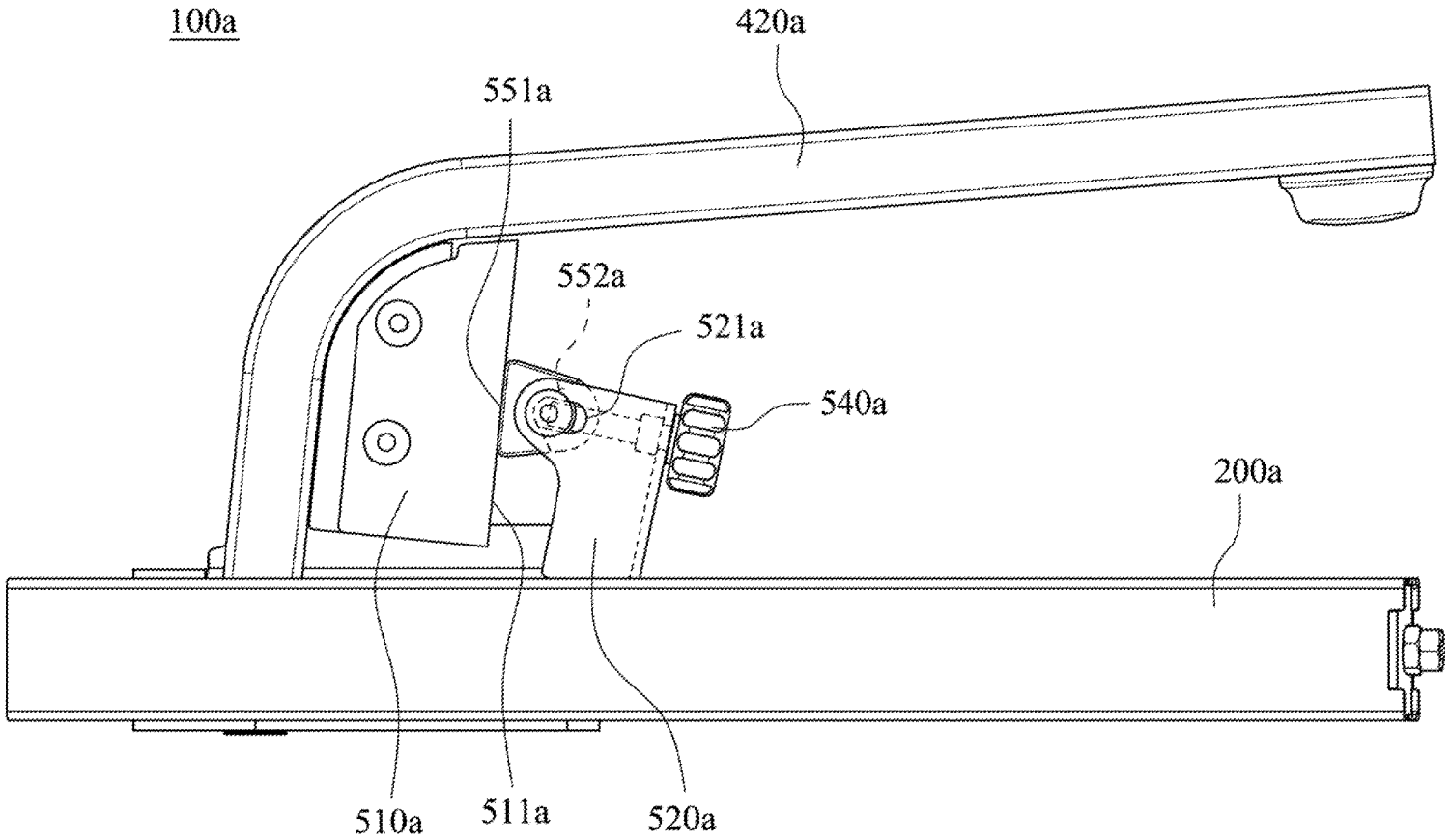
FIG. 17B is a side view of the stepper of FIG. 17A.

FIG. 17A is a schematic view showing a stepper 100*a* according to one embodiment of the present disclosure; and FIG. 17B is a side view of the stepper 100*a* of FIG. 17A. In FIGS. 17A and 17B, the adjusting sheet 530*a* (as shown in FIG. 14) is removed, and the adjusting member 540*a* is integrally constructed. Because two adjusting holes 521*a* are extended horizontally, the horizontal position of the eccentric member 550*a* can be adjusted by the adjusting holes 521, an inclined angle of the first blocking surface 511*a* of the blocking member 520*a* can be adjusted, and thus the pedal stroke and swing angle of the pedal 400*a* can be changed.

In sum, the stepper of the present disclosure has the following advantage.

(a) Reciprocately stamping functionalities can be obtained by using a simple structure of the linking rod and the adjusting mechanism.

(b) As to the up and down swing of the pedal, the structure of the linking rod and the mechanism of the present disclosure is more stable than the conventional linking structure utilizing lever principle and V-type swing.

(c) The pedal can swing up, down, left and right by incorporating the linking rod, the inclined direction of the blocking member and the eccentric member of the adjusting mechanism.

(d) The corresponding axial distance of the second blocking surface of the eccentric member can be freely selected to adjust the pedal stroke and the swing angle.

(e) The adjusting mechanism can be freely adjusted to meet different requirements of the pedal stroke and the pedal swing for different users, and the inclined angles and positions of the first blocking surface and the second blocking surface can be adjusted by adjusting the adjusting member, the adjusting base, the adjusting sheet and the screws.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A stepper comprising:

a base;

a linking rod disposed on the base, wherein the linking rod comprises two ends that are concentrically rotated with each other;

two pedals, each of the pedals comprising:

a pedal member; and a pedal arm connected to the pedal member, wherein the pedal arm is L-shaped and pivotally connected to one end of the linking rod for reciprocately raising or lowering the pedal member; and two adjusting mechanisms, each of the adjusting mechanisms comprising:

a blocking member disposed in a corner of the pedal arm, the blocking member comprising a curved surface against the corner of the pedal arm and a first blocking surface;

an adjusting base disposed on the base;

an eccentric block pivotally connected to the adjusting base via an axial center on the adjusting base, wherein the eccentric block is rotatable around the axial center, the eccentric block comprising a plurality of second blocking surfaces, and one of the second blocking surfaces resists the first blocking surface;

an adjusting member for adjusting a rotating angle or a position of the eccentric block;

wherein when one of the pedals is lowered along a gravity direction, one of the first blocking surfaces and one of the second blocking surfaces are inclined relative to the gravity direction to correspondingly move one end of the linking rod, and the other end of the linking rod is concentrically rotated, and the first blocking surface of the other blocking member is resisted by one of the second blocking surfaces of the other eccentric block, thereby swinging and raising the other pedal.

2. The stepper of claim 1, wherein the adjusting member is a plug.

3. The stepper of claim 1, wherein the adjusting member is a bolt.

4. The stepper of claim 1, wherein the adjusting base comprises a plurality of adjusting holes, and the eccentric block is rotatably disposed on the adjusting base.

5. The stepper of claim 4, wherein the adjusting mechanism comprises:

an adjusting sheet having a plurality of fixing holes; and a plurality of screws disposed through the adjusting holes and positioned in the fixing holes, and the adjusting member is selectively disposed through two fixing holes and two adjusting holes, thereby adjusting the eccentric block by the adjusting member and the adjusting sheet.

6. The stepper of claim 1, wherein the first blocking surface is made from elastic material.

* * * * *